US007198460B2

(12) United States Patent
Holt

(10) Patent No.: US 7,198,460 B2
(45) Date of Patent: Apr. 3, 2007

(54) HYDRAULIC OR PNEUMATIC MACHINE WITH TILTING BLADES

(76) Inventor: Corneliu Holt, Str. Stānilānr.6, apt 59, Sector 3, R-7000, Bucuresti (RO)

( * ) Notice: Subject to any disclaimer, the term of this patent is extended or adjusted under 35 U.S.C. 154(b) by 58 days.

(21) Appl. No.: 10/538,644

(22) PCT Filed: Dec. 12, 2002

(86) PCT No.: PCT/RO02/00025

§ 371 (c)(1),
(2), (4) Date: Jun. 10, 2005

(87) PCT Pub. No.: WO2004/053297

PCT Pub. Date: Jun. 24, 2004

(65) Prior Publication Data

US 2006/0083618 A1 Apr. 20, 2006

(51) Int. Cl.
*F04D 29/18* (2006.01)

(52) U.S. Cl. ..... 415/140; 415/207; 416/117; 416/136; 416/140

(58) Field of Classification Search ..... 415/64, 415/130, 140, 141, 207; 416/117, 142, 136, 416/140

See application file for complete search history.

(56) References Cited

U.S. PATENT DOCUMENTS 2,557,427 A 6/1951 Gibson
3,928,771 A 12/1975 Straumsnes
4,045,148 A * 8/1977 Morin ..... 416/117
4,132,213 A 1/1979 Weaver
6,537,018 B2 * 3/2003 Streetman ..... 415/3.1

FOREIGN PATENT DOCUMENTS

DE 25 47 324 2/1977
RO 1109230 B1 6/2003

* cited by examiner

*Primary Examiner*—Edward K. Look
*Assistant Examiner*—Dwayne J White
(74) *Attorney, Agent, or Firm*—The Nath Law Group; Gregory B. Kang; Jerald L. Meyer

(57) ABSTRACT

This invention refers to a hydraulic or pneumatic machine with tilting blades, running either as an engine on a fluid flow or on pressure fluid or as a pump or a compressor. The hydraulic or pneumatic machine on a fluid flow according to the invention consists of a cylindrical casing with inlet and outlet openings, radially arranged, diametrically oposed, along the fluid flowing direction, some disk like rotors with tilting blades, hinged over their front faces and provided with driving mechanisms of their own, and some fixed drums located between the rotors, concentrically to them, making inside the machine some channels, symetrically arranged on one or several stages. Flowing through the channels, the fluid drives the tilting blades causing the movement of the rotors, all the rotors moving to one sense being coupled to the same outlet shaft of the machine. The tilting blades of the hydraulic or pneumatic machine operating according to the invention with pressure fluid, run in variable depth grooves located in the rings between the front faces of the rotors and connected to the fluid circuit, the operation conditions of the machine—motor or pump—being determined by the moving sense of the blade in the groove.

18 Claims, 18 Drawing Sheets

HYDRAULIC OR PNEUMATIC MACHINE WITH TILTING BLADES

TECHNICAL FIELD OF THEE INVENTION

The invention pertains to a hydraulic or pneumatic machine with tilting blades in simple and solid construction which can be built in various constructional variants, meant to run with high efficiency as an engine fed by a fluid stream, pressure stream or pressure gases resulted from fuel combustion or as a pump or compressor with a broad range of industrial applications.

BACKGROUND OF THE INVENTION

There is a large variety of hydraulic or pneumatic machines having the rotor equipped with swinging or tilting blades round a fixed shaft on the rotor parallel or perpendicularly to its rotation axis driven by its own weight, by the centrifugal force or by its own driving mechanisms. During a full rotor rotation, the blades are putting up the maximum resistance to the motion to the fluid stream sense taking over part of its energy and the minimum resistance to the motion to the opposite sense of the fluid stream.

Such machines have the disadvantage of a sturdy, sophisticated, low efficiency construction.

There are also hydraulic or pneumatic machines—motors or pumps—using pressure working fluids, being equipped either with gliding blades in the rotor or hinged blades on it, having the disadvantage of very narrow application ranges from the point of view of the working parameters and of a very elaborate execution in terms of accuracy, a rapid wearing of the active elements, very high stresses in the rotors bearings and an outlet couple with variable value.

The technical issue solved by this invention consists in the execution of a hydraulic or pneumatic machine having rotors provided with tilting blades which assures the taking over of the moving energy of the whole amount of fluid throughout and can be integrated—alone or in a battery of machines—in units to capture the energy of a moving fluid for a very wide range of fluid flow rates.

DISCLOSURE OF INVENTION

The hydraulic or pneumatic machine with tilting blades according to the invention permits to achieve the goal as it can be built in various constructional variants, running either as a hydraulic or pneumatic motor on fluid stream with one stage, made up of a cylindrical casing with flat or shaped lids and radial inlet and outlet nozzles for the working fluid, diametrically opposed, arranged to the fluid flow direction, two coaxial disc like rotors, having the diameters close to that of the casing, found under rotation movement in the opposite sense to one another due to some shaped tilting blades—of a rectangular shape, or, eventually, having two opposite curve sides—radially arranged or in an angle to the radius, hinged onto the neighbouring front surfaces of the two rotors, towards their periphery, the angle formed in the hinge, between the rotor surface and that of the associated blade, having the vertex arranged to the moving sense of each rotor and the values varying during the rotor rotation—between 0°—when the blade is in passive position, eventually located in a properly shaped seat on the face of the respective rotor—and a maximum angle of 90° eventually—when the blade is in active position, the position of the tilting blades on each rotor being driven, during the rotor rotation, by a driving mechanism of its own, with cams, known in themselves; a cylindrical dram located between the front faces provided with the tilting blades of the rotors, coaxial with them, fixed onto the machine casing by a shaped deflector and a rib found within the symmetry plane of the inlet—outlet nozzle, so that inside the machine are formed two channels having a rectangular cross section, constat height, symetrically arranged, delimeted by the front face of the two rotors, the inner face of the casing and the outer face of the drum, the dimensions and the shape of the tilting blades being selected in such a way that, when they are in active position they obturate the fluid outlet channel while in, passive position they should not hinder the blades movement on the other rotor, during a full rotation of each rotor, its blades being in active position only on a part of one of the two channels, namely, when they move to the working fluid direction, the symmetrical construction of the channels determining the movement to the opposite sense of the two coaxial rotors, each connected to a central shaft, the two coaxial shafts of the machine having the possibility to get out of the machine, either individually through the lid located close to the respective rotor, provided with bearings and the corresponding sealing devices, or both of them through one lid, one of the shafts being tubular and having inside bearings and sealing devices necessary to the other to rest against it, the movement of the two shafts to the opposite sense being summed up by means of some mechanisms such as cone or planetary gears, known in themselves and being transmitted to a single outlet shaft of the machine; or, in order to allow the circulation of increased fluid flow rates, with fluid circulation channels arranged along several stages, having several rotors, the extreme ones with tilting blades on one front face while those in intermediate positions with tilting blades on both front faces, the orientation of the tilting blades on each rotor being such that the neighbouring rotors move to opposite sense to one another, all the rotors moving to one sense being rigidly coupled between them, thus maldng a package so that inside the machine there are two packages of rotors, moving to opposite sense from one another, each package being connected to one of the two shafts of the machine to which they transmit the motion received from the working fluid, the tilting blades being driven by the driving mechanisms of each rotor, or a common driving mechanism for all the rotors of the respective package as well as a number of drums corresponding to the number of the machine stage, coupled between them, in fixed position to the casing having the deflector within the symmetry plane of the inlet opening; or as a hydraulic or pneumatic machine running with a static pressure fluid, with one or several stages, the tilting blades of the rotors running in some shaped channels with variable depth, made on the front faces of a cylindrical ling fixed on the drum within the space between the front faces of two successive rotors, each channel eventually framed, partially or along the whole periphery, by baffles or labyrinths made on the front face of the respective ring in order to diminish the fluid losses—having an initial zone of growing depth, to the rotation sense of the respective rotor followed by a middle zone with constant depth and a final zone with decreasing depth, the profile of the channel faces being the same as that of the surfaces formed by the corresponding edges of the tilting blade during its motion, so that the interstice between the edges of the blade panel and the corresponding walls of the channel get minimum values during the blade running in the respective channel, in other variants, the middle zone of the channel may be absent or the final zone may have constant depth, the channels on the two faces of the cylindrical ring may have the middle zone open to the other rotor or closed—the two channels overlapping eventually along a certain portion—function on the channel depth being equal or lower than the height of the cylindrical ring; each channel being connected to the inlet nozzle by one or several slots or a groove made on a portion or on the whole initial part of it, as the working fluid is compressible—a gas, incompressible—a liquid respectively, and to the outlet nozzle through one or several slots or groove made along the entire final zone of the respective channel; inside each channel, between the successive blades of each rotor, some mobile compartments are formed, with variable volume during a full rotation of the respective rotor, the functional role of the machine depending on the position of the tiding blade against the moving sense of the rotor it is fastened to, namely: an engine, if the angle vertex between the blade and the rotor face is orientated to its moving sense, the compartments formed between two neighboring tilting blades having an increasing volume on the initial part of the channel, the instantaneous motive force arising in each compartment of the respective zone being proportional to the depth difference of the channel, in that moment, near the two tilting blades delimiting each compartment and the pressure of the respective compartment; a pump or a compressor, if angle vertex between the blade and the face of the rotor is orientated to the opposite sense of the rotor moving sense, the shaft of which is driven by an outside couple, the fluid being sucked in this case in the final zone of the channel and compressed in its initial zone; in various constructive variants either on the faces of a cylindrical ring may be provided with several channels, independent or coupled between them, in series—through some intermediate, shaped channels—or in parallel, making different circuits accordingly, coupled or independent ones having the same functional role or various roles, the driving mechanisms of the tilting blades being orientated according to the position of the channel or of the respective circuit or in case the machine is staged, the fluid circuits from various stages being coupled by means of some connecting pipes or by some spacer rings with the corresponding inner channels located between the cylindrical rings of each stage, in a variant, in order to diminish the axial forces resulting in the bearings of the rotors shafts the machine having at all the stages only rotors with tilting blades on both faces whereas in another variant it has a single outlet shaft locating one or several similar rotors, with tilting blades on one or both front faces, the machine being able to run as a pneumatic motor—fed on pressure gas coming from an outside tank or from the fuel combustion in a combustion room equipped with feeding devices, for the formation of the fuel mixture and its ignition, known in themselves-ensuring expansion of the working gas in one channel or a prolonged expansion in several coupled channels, or as a hydraulic motor fed on a pressure liquid, or as a pump or compressor, or with both motive and independent pumping circuits. Against the known solutions, the hydraulic or pneumatic machine, according to the invention, has several advantages, such as:

the possibility to make highly efficient motors on fluid flow, having reduced size rotors and low value starting couple due to the fluid circulation through the machine in symmetrically arranged channels on one or several stages and to the flow concentrations due to the convergent shape of the respective channel whereas the energy conversion system is coupled to the motor shaft—an electric generator eventually—located outside the fluid flow;

the possibility to build sturdy machines with a low number of parts under rotation and a very low number or no number of parts at all under translator motion, with low values of forces and relative velocities in the contact points between the parts;

the possibility to build motors with quasiconstant couple at the outlet shafts;

the possibility to build balanced machines with axial and radial forces having minimum values in the rotors bearings;

the possibility of making pneumatic machines, engines or compressors where the prolonged expansion or fluid compression respectively is achieved in circuits consisting of one or several channels coupled in series or in parallel, the small pressure differences between the compartments formed along the channels, between the successive blades of each rotor, resulting in low stresses in the tilting blades and in the bearings thereof as well as in low pressure loss values between the successive compartments or towards the outside;

the possibility of achieving a large constructional variety of units to make best use of the kinetic energy of a fluid flow, with constant or variable direction continuous or intermittent flow, floating or fixed units, in unsophisticated, solid construction and with small overall dimensions;

the possibility of making a wide constructional variety of hydraulic or pneumatic machines for static pressure fluids, with one or several circuits having the same functional role—motor or pump—or different roles, with the same fluid in all circuits or with different fluids;

the possibility to make a thermal machine with a low number of parts or no parts at all under translator movement, with high mechanical efficiency, having the combustion room incorporated inside or outside, with the compression circuits of the air or the fuel mixture and burned gases expansion circuits respectively located in the same or different machines.

Herein under are several examples of the way the invention is materialised making also reference to FIGS. 1–123.

BEST MODE FOR CARRYING OUT

EXAMPLE 1

Figure 1:
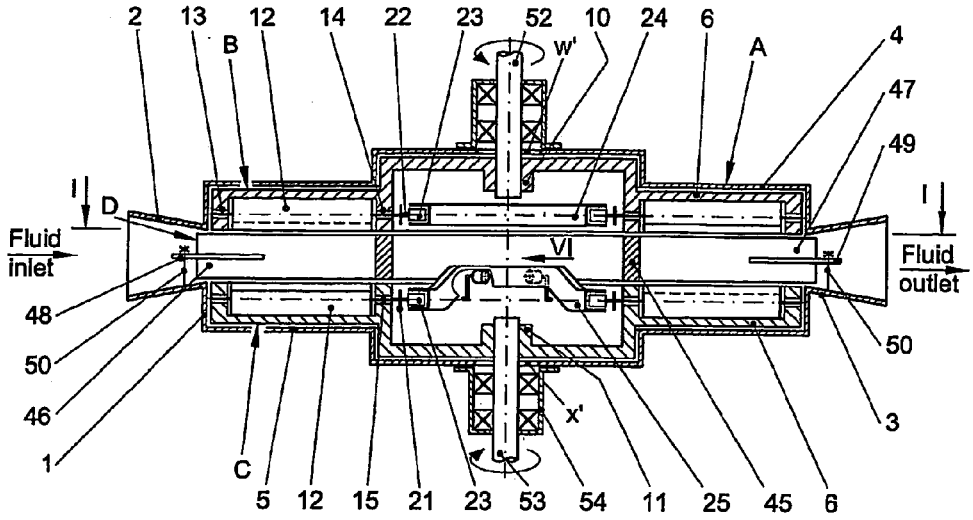
FIG. 1—Cross section in vertical plane of a hydraulic or pneumatic machine, according to the invention, in one constructional variant.
Figure 2:
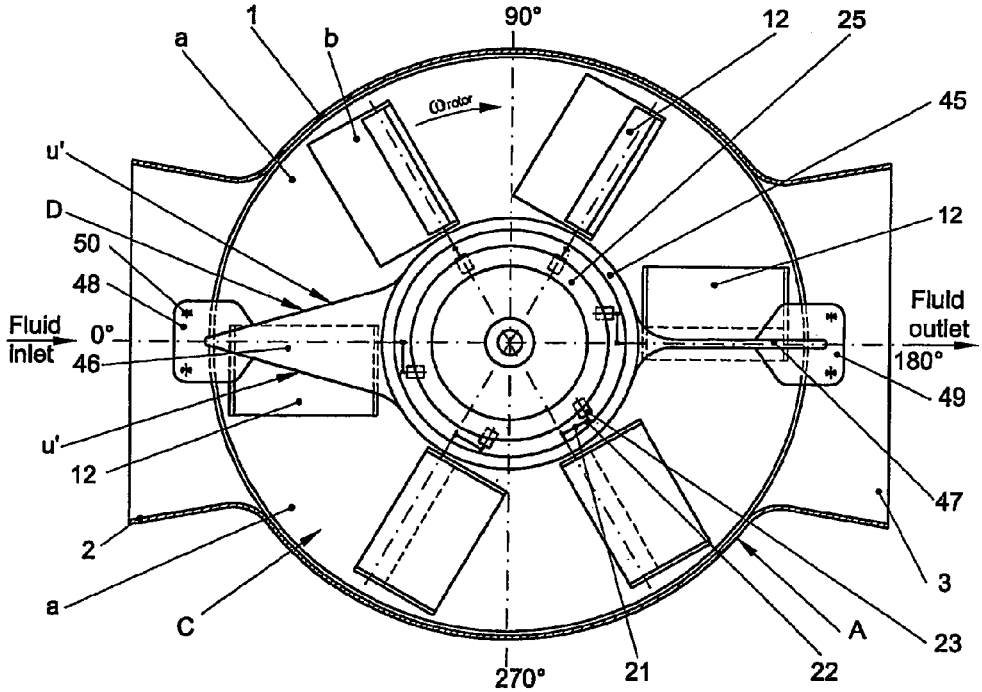
FIG. 2—Cross section in horizontal plane, to line I—I of FIG. 1.
Figure 3:
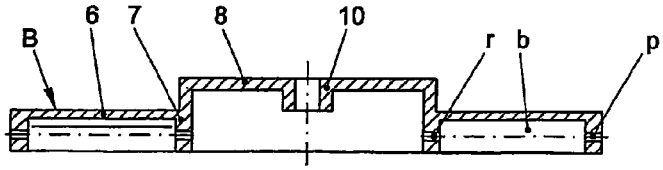
FIG. 3—Cross section of the upper rotor, in a constructional variant.
Figure 4:
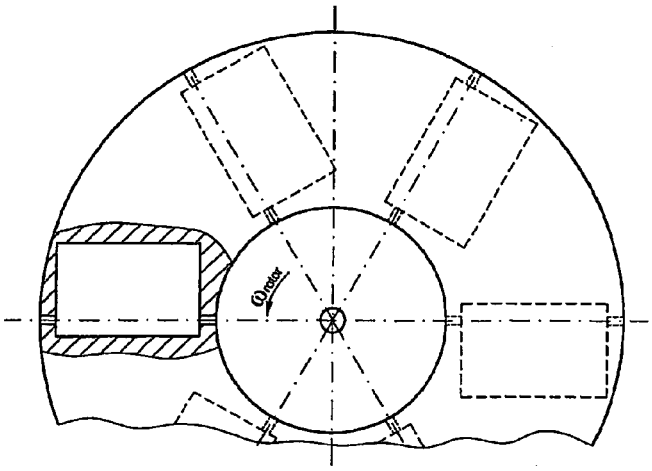
FIG. 4—Partial top view of the upper rotor B shown in FIG. 3.
Figure 7:
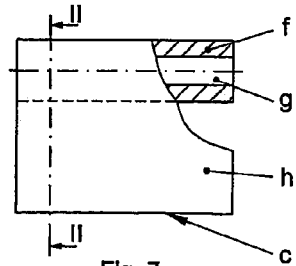
FIG. 7, 8—Top view of tilting blade 12, in various constructional variants.
Figure 8:
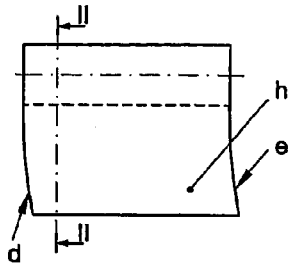
Figure 5:
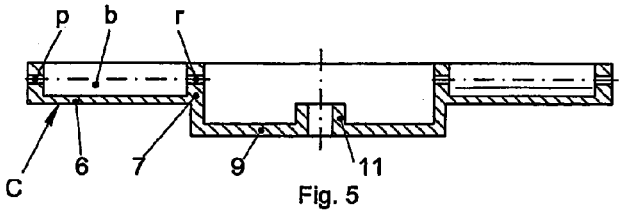
FIG. 5—Cross section of the lower rotor C in a constructional variant.
Figure 9:
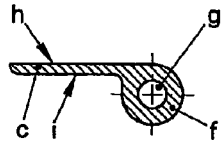
FIG. 9-11—Cross section to line II—II shown in FIG. 8, 9 of the tilting blade 12 in various constructional variants.
Figure 6:
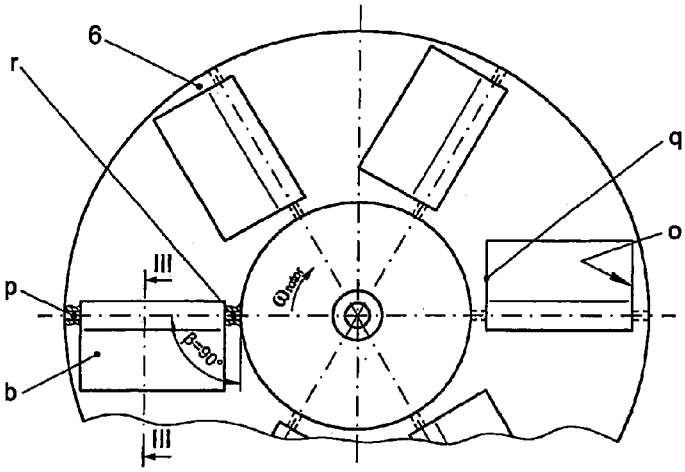
FIG. 6—Partial top view of the lower rotor C shown in FIG. 5.
Figure 10:
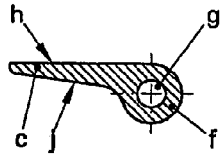
Figure 11:
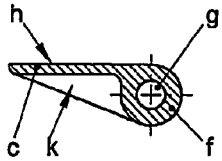
Figure 12:
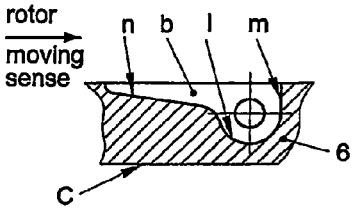
FIG. 12—Cross section to line III—III shown in FIG. 6, of a shaped channel b.
Figure 13:
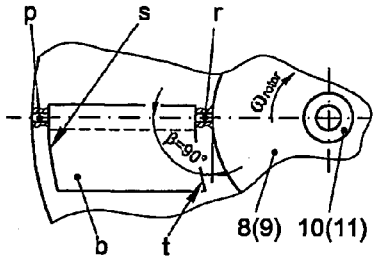
FIG. 13-16—Partial view of a front face of a rotor (B, C) in various constructional variants.
Figure 14:
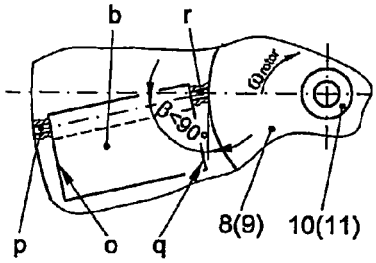
Figure 15:
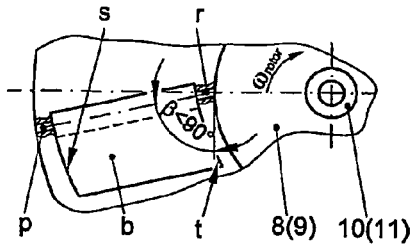
Figure 16:
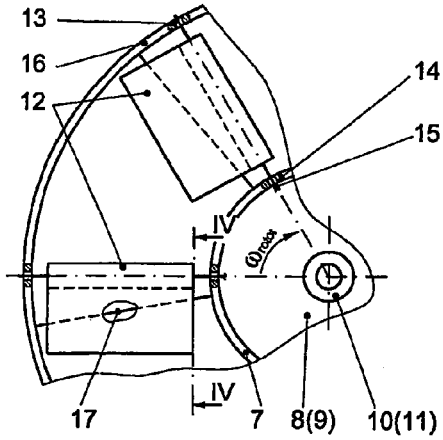
Figure 19:
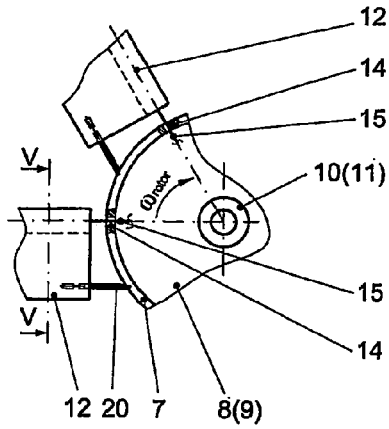
FIG. 19—Partial view of a front face of a rotor (B, C) in another constructional variant.
Figure 17:
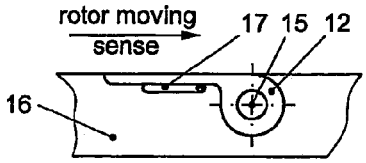
FIG. 17—Cross section to line IV—IV of FIG. 16.
Figure 20:
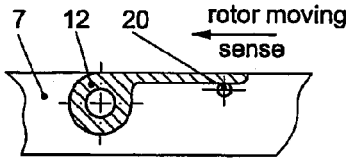
FIG. 20—Cross section to line V—V shown in FIG. 19.
Figure 18:
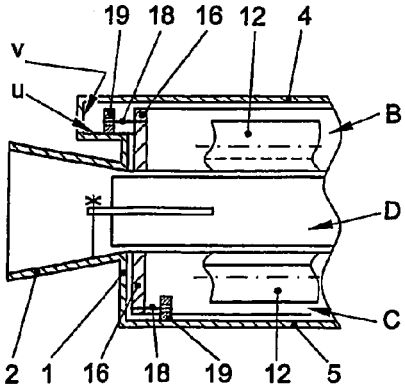
FIG. 18—Partial cross section in vertical plane of a hydraulic or pneumatic machine according to the invention, in a constructional variant.
Figure 21:
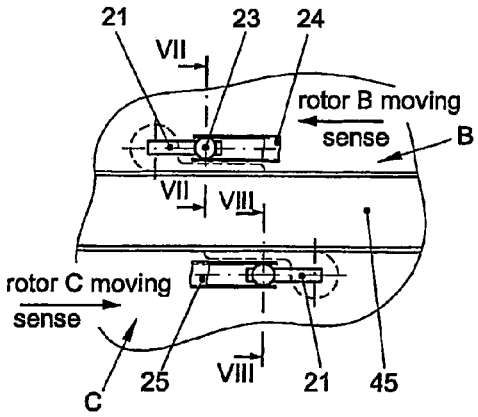
FIG. 21—Partial view from the direction VI of the tilting blades driving mechanisms shown in FIG. 1.
Figure 22:
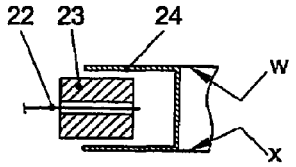
FIG. 22—Partial section to line VII—VII shown in FIG. 21.
Figure 23:
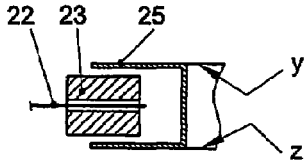
FIG. 23—Partial section to line VIII—VIII shown in FIG. 21.
Figure 24:
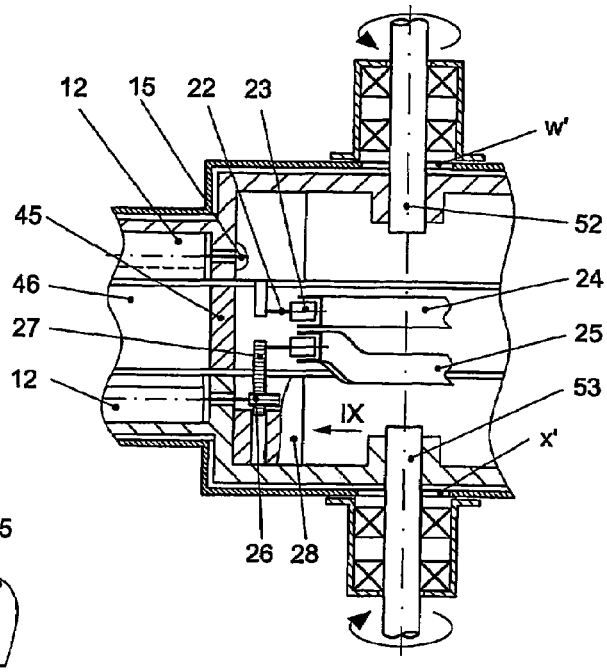
FIG. 24—Partial cross section in vertical plane of a machine according to the invention, with a constructional variant of the tilting blade driving mechanism.
Figure 25:
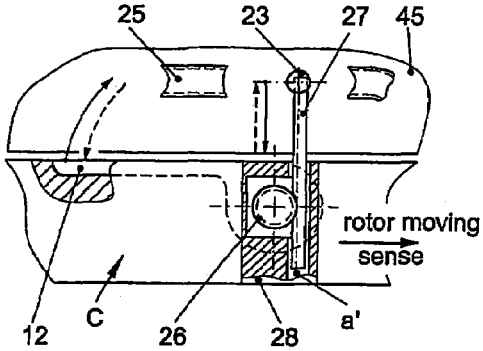
FIG. 25, 26—Partial view from direction IX with the schematic diagram of the moving sense of the blade and tappet in various assembling variants.
Figure 26:
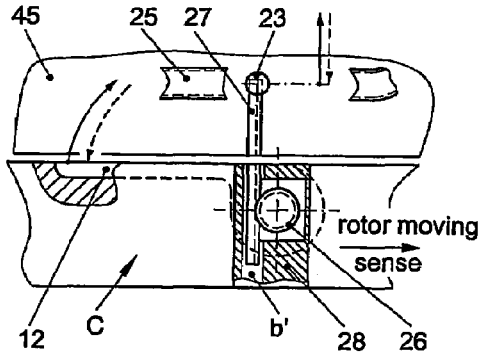
Figure 27:
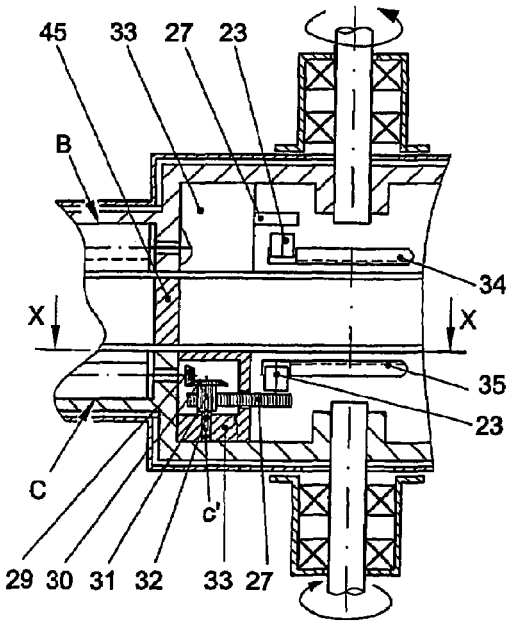
FIG. 27—Partial cross section in vertical plane of a machine according to the invention, in another constructional variant of the tilting blade driving mechanism.
Figure 28:
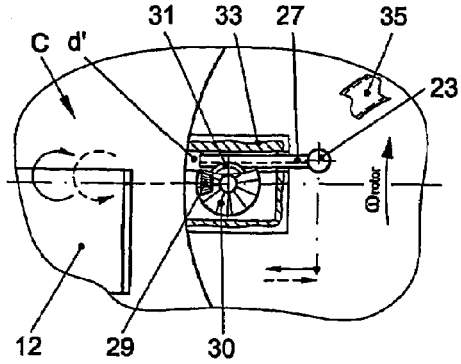
FIG. 28, 29—Partial cross section to line X—X with the schematic illustration of the moving sense of the tilting blade and the tappet in various assembling variants.
Figure 29:
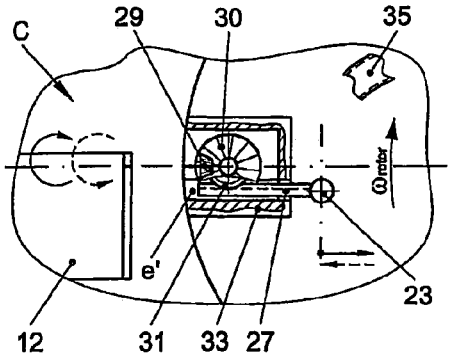
Figure 30:
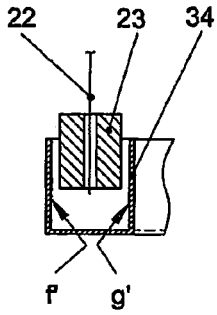
FIG. 30—Detail of the guide faces of the cam no. 34.
Figure 31:
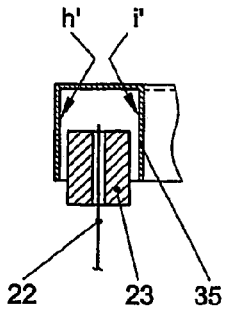
FIG. 31—Detail of the guide faces of the cam no. 35.
Figure 32:
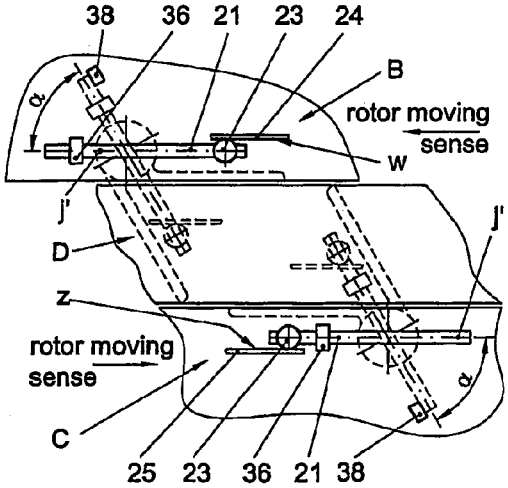
FIG. 32-35—The schematic diagram of the lever driving mechanism shown in FIG. 21, in various constructional variant.
Figure 33:
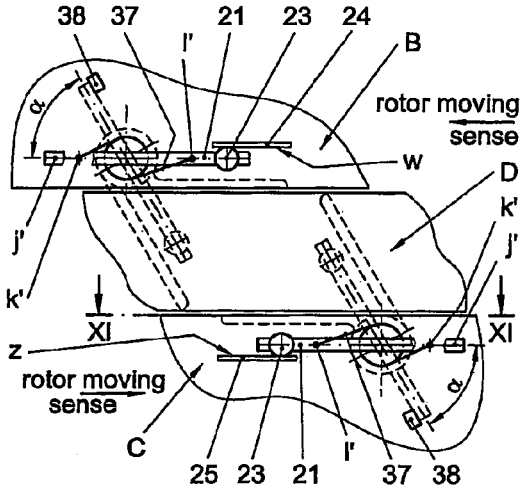
Figure 34:
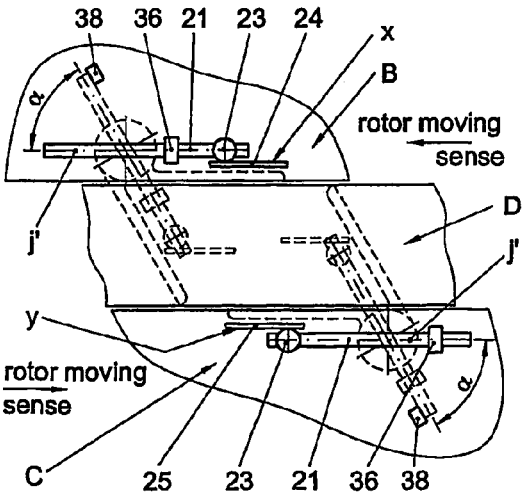
Figure 35:
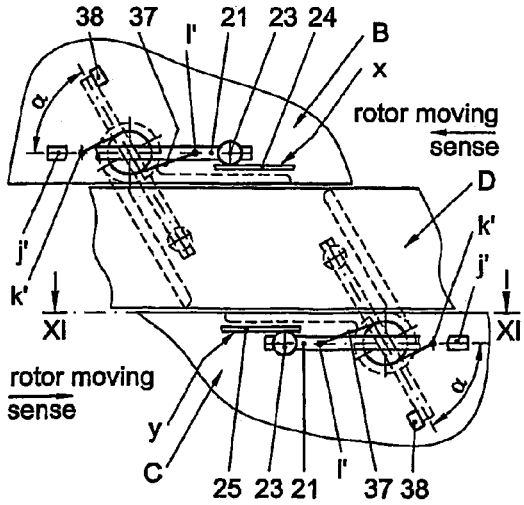
Figure 36:
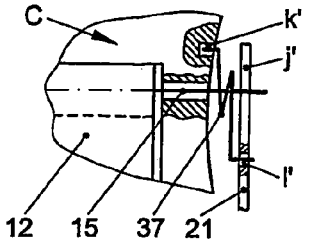
FIG. 36—Partial section, rotated in horizontal plane, to line XI—XI shown in FIGS. 33, 35 and 41.
Figure 37:
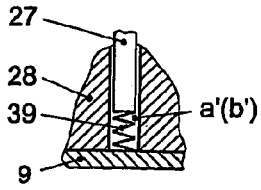
FIG. 37—Assembling detail of the tappet at the driving mechanism shown in FIGS. 25, 26, in a constructional variant.
Figure 38:
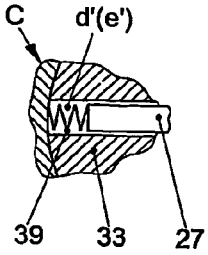
FIG. 38—Assembling detail of the tappet for the driving mechanism shown in FIGS. 28, 29, in a constructional variant.
Figure 39:
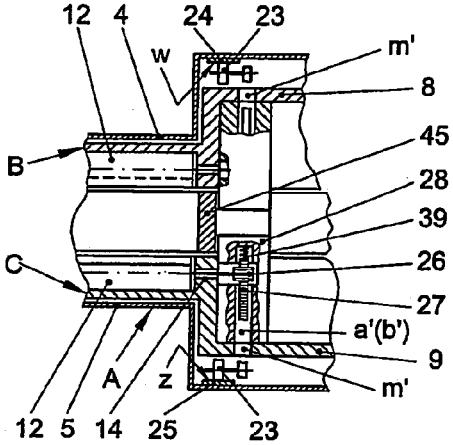
FIG. 39, 40—Partial cross section in vertical plane of a machine according to the invention, in other constructional variants of the tilting blade driving mechanism.
Figure 40:
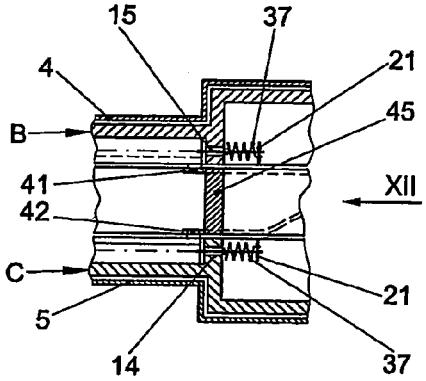
Figure 41:
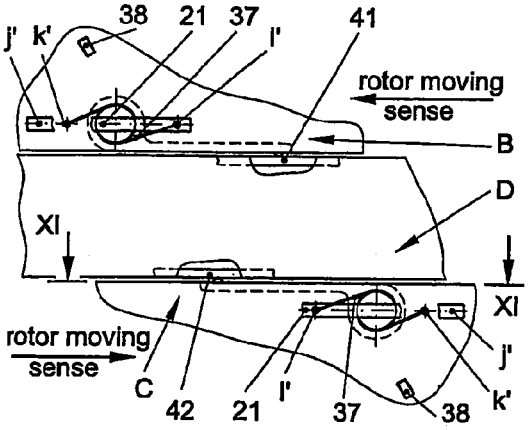
FIG. 41, 42—Partial view from direction XII of the driving mechanism of the blades shown in FIG. 40 in various constructional variants.
Figure 42:
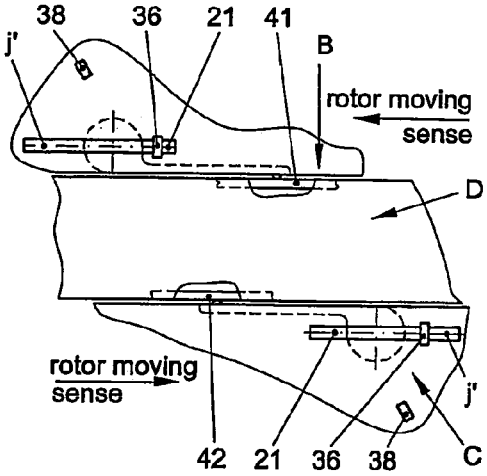
Figure 43:
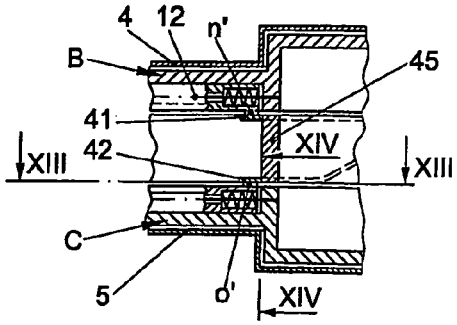
FIG. 43—Partial cross section in vertical plane of a machine according to the invention, in another constructional variant of the tilting blade driving mechanism.
Figure 44:
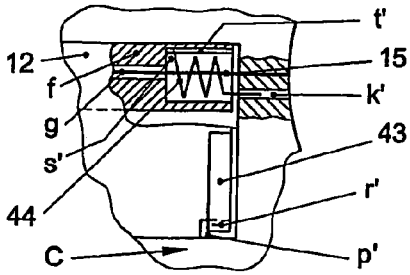
FIG. 44, 45—Section to line XIII—XIII shown in FIG. 43, in various constructional variants.
Figure 45:
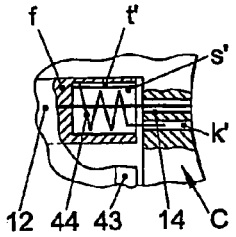
Figure 46:
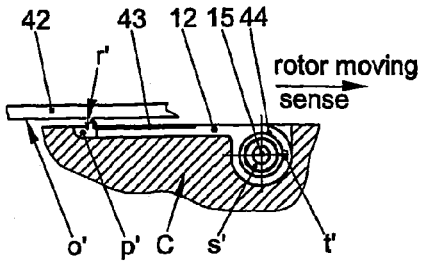
FIG. 46—Section to line XIV—XIV shown in FIG. 43.
Figure 47:
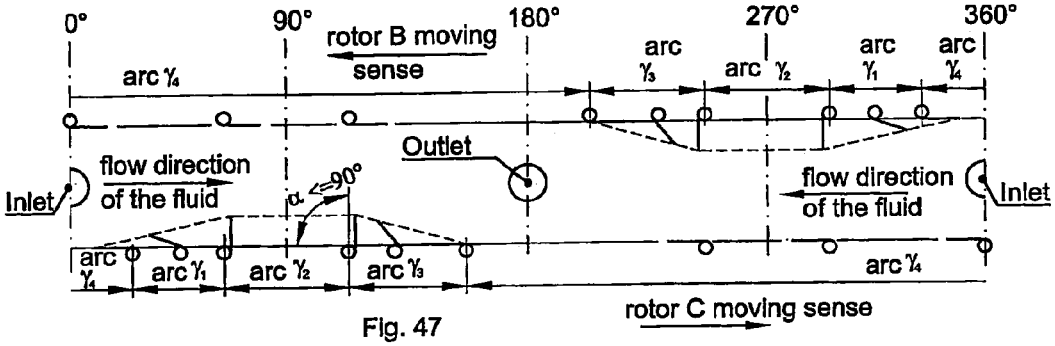
FIG. 47—Developed schematic diagram of the partial evolution of the blade on each rotor during its full rotation.
Figure 48:
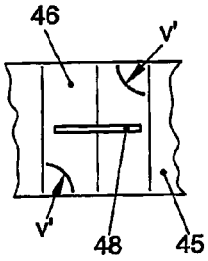
FIG. 48—Front view of deflector 46 in a constructional variant.
Figure 49:
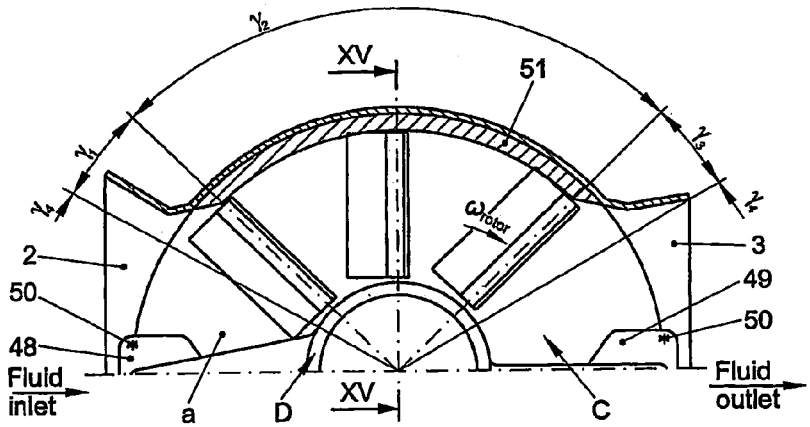
FIG. 49—Partial cross section in horizontal plane to line I—I shown in FIG. 1 in a constructional variant.
Figure 50:
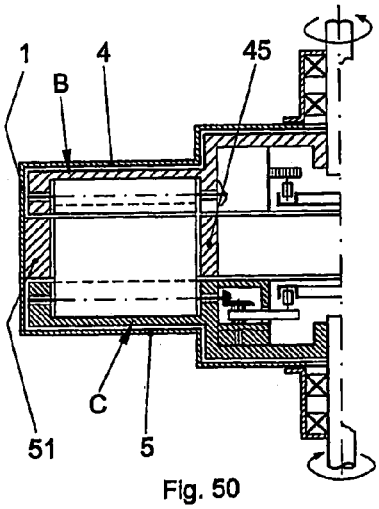
FIG. 50—Partial cross section in vertical plane to line XV—XV shown in FIG. 49.
Figure 51:
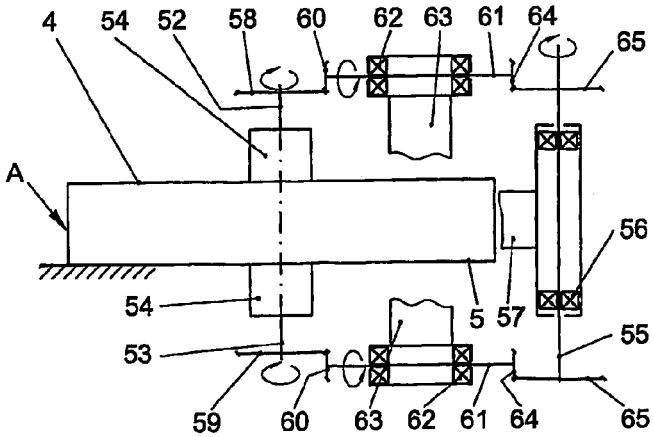
FIG. 51—Schematic diagram of the coupling of opposite outlet shafts of the machine to a single outside shaft.
Figure 52:
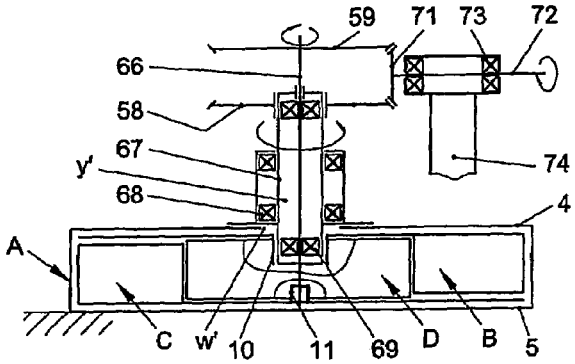
FIG. 52—Schematic diagram of a machine according to the invention with coaxial outlet shafts coupled to a single outside shaft.
Figure 53:
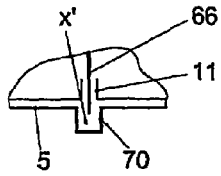
FIG. 53—Partial schematic diagram of an additional bearing located on the lower lid, a variant to FIG. 52.
Figure 55:
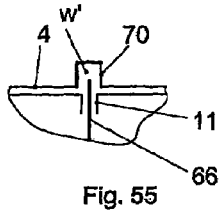
FIG. 55—Partial, schematic diagram of an additional bearing located on the upper lid, a variant to FIG. 54.
Figure 54:
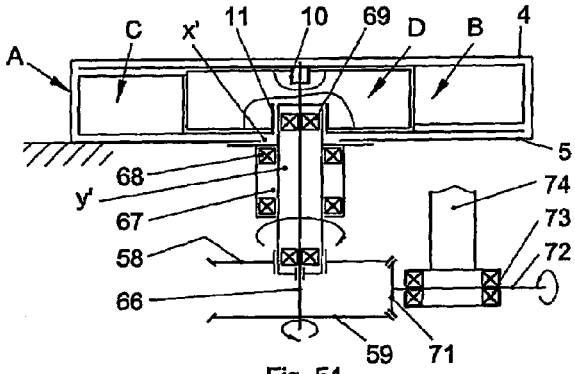
FIG. 54—Schematic diagram of a machine according to the invention with coaxial outlet shafts coupled to a single outside shaft, in a constructional variant.
Figure 56:
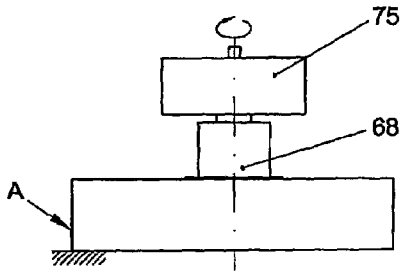
FIG. 56—Schematic diagram of a machine according to the invention in one assembling variant.
Figure 57:
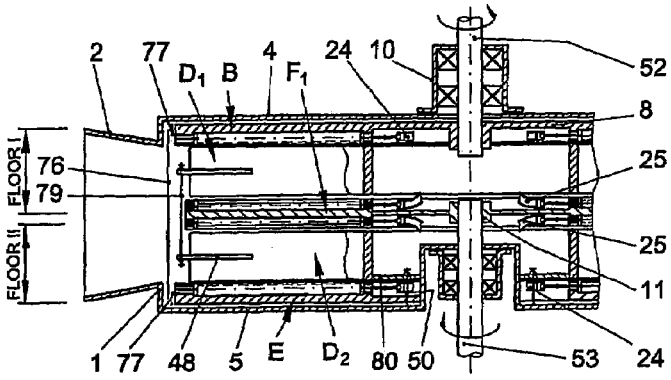
FIG. 57, 58—Partial cross section in vertical plane of a hydraulic or pneumatic machine according to the invention with channels on two stages, in various constructional variants.
Figure 58:
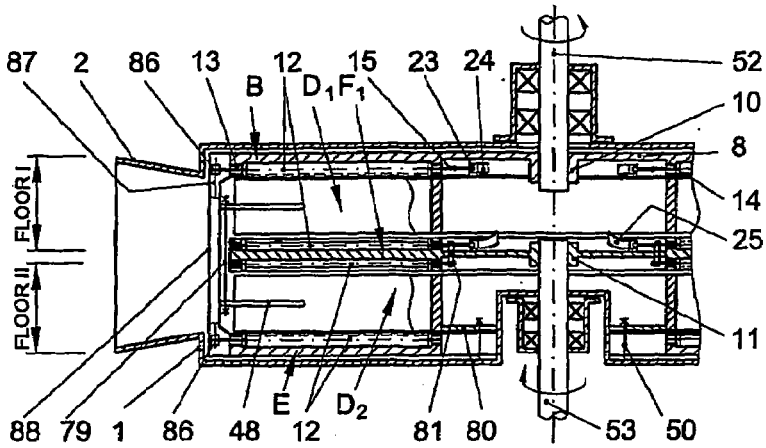
Figure 59:
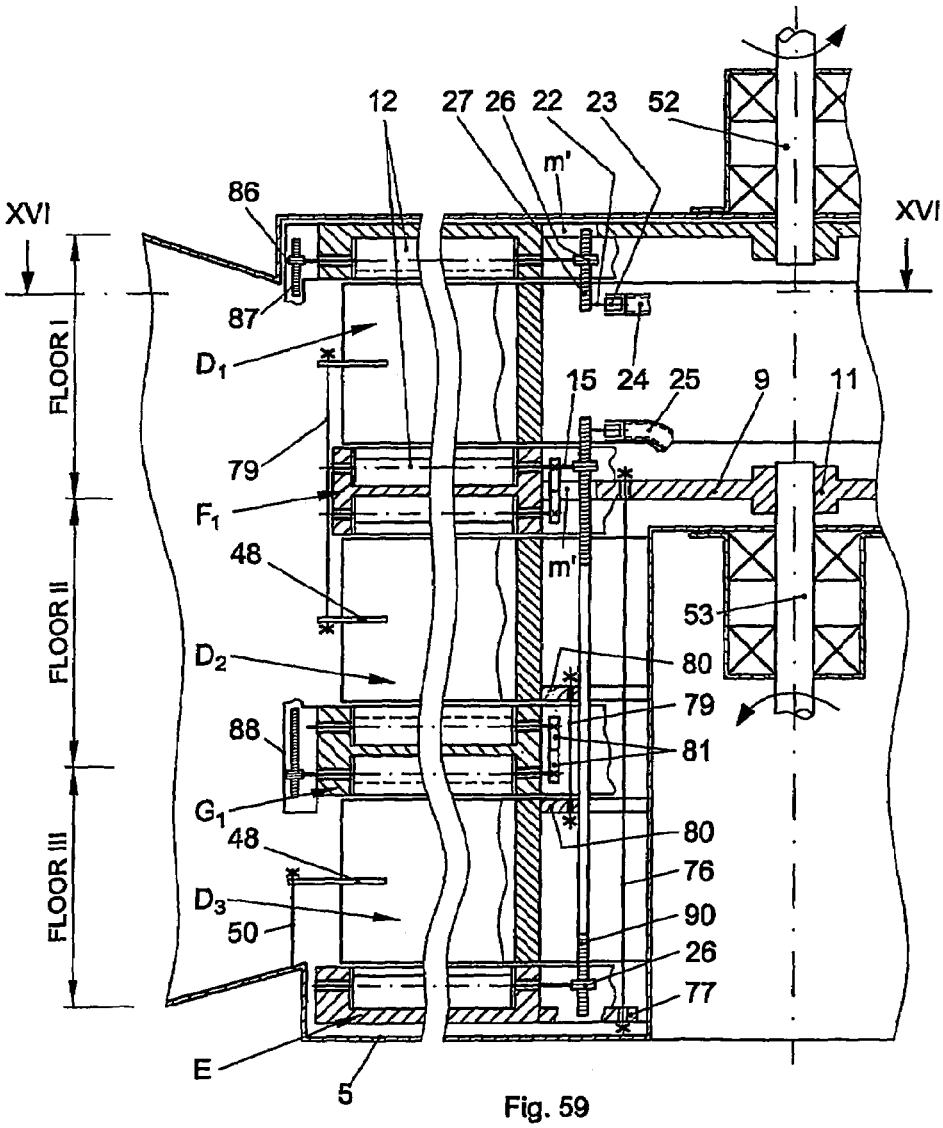
FIG. 59—Partial cross section, in vertical plane, of a hydraulic or pneumatic machine according to the invention with channels on three stages.
Figure 60:
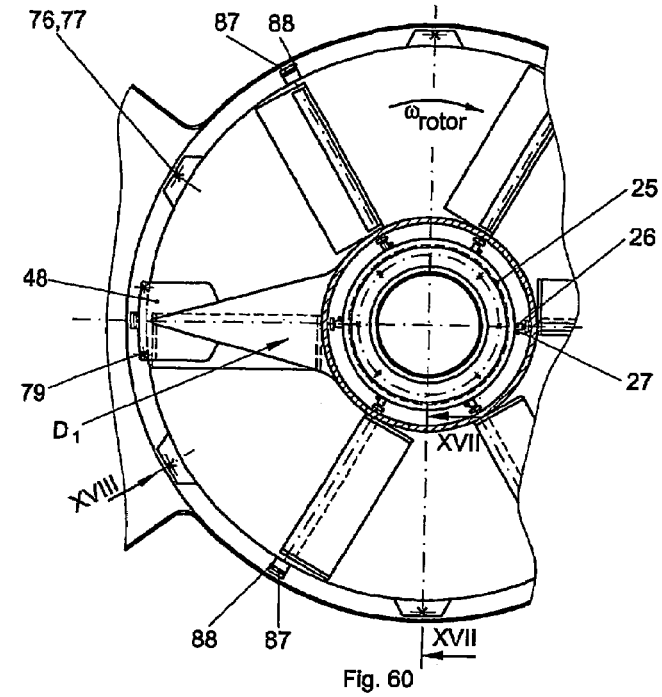
FIG. 60—Cross section to line XVI—XVI shown in FIG. 59.
Figure 61:
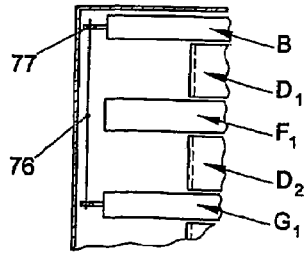
FIG. 61—Cross section to line XVII—XVII shown in FIG. 60.
Figure 62:
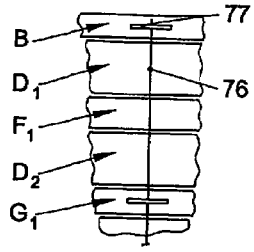
FIG. 62, 63—View from direction XVIII shown in FIG. 60 in various constructional variants, FIG. 64—Partial cross section of a E type rotor.
Figure 63:
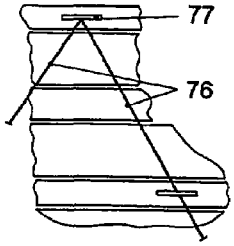
Figure 64:
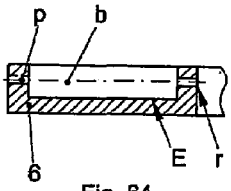
Figure 65:
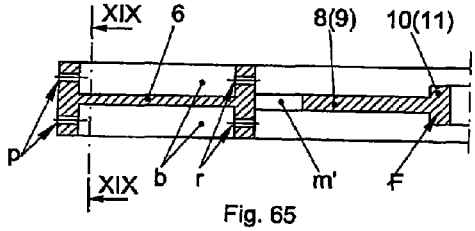
FIG. 65-68—Partial cross section of a F type rotor in various constructional variants.
Figure 66:
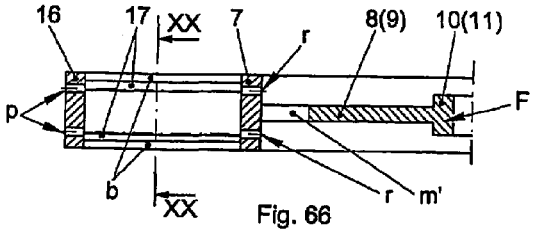
Figure 67:
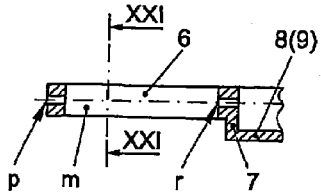
Figure 68:
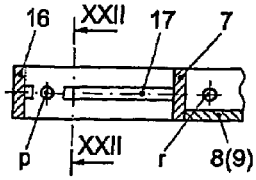
Figure 69:
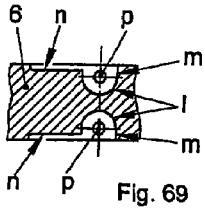
FIG. 69—Section to line XIX—XIX shown in FIGS. 65 and 73.
Figure 70:
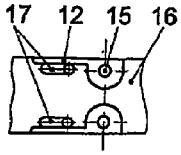
FIG. 70—Section to line XX—XX shown in FIGS. 66 and 74.
Figure 71:
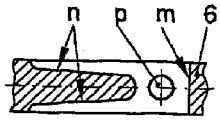
FIG. 71—Section to line XXI—XXI shown in FIGS. 67 and 75.
Figure 72:
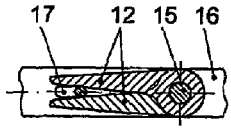
FIG. 72—Section to line XXII—XXII shown in FIGS. 68 and 76.
Figure 73:
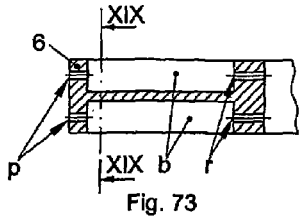
FIG. 73-76—Partial cross section of a G type rotor in various constructional variants.
Figure 74:
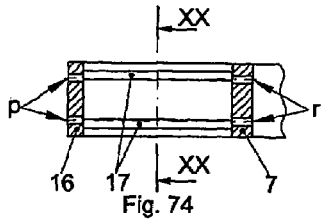
Figure 75:
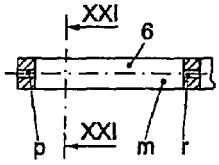
Figure 76:
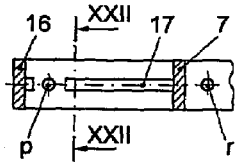
Figure 77:
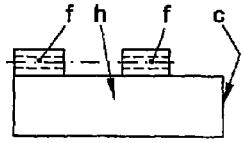
FIG. 77—Detail of "hinge" type tilting blade.
Figure 78:
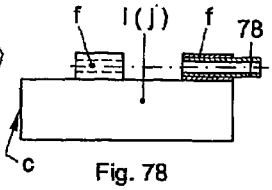
FIG. 78—Detail of "hinge" type tilting blade matching that shown in FIG. 77.
Figure 79:
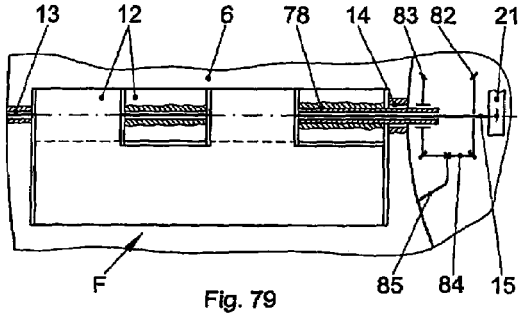
FIG. 79-81—Detail of the driving mechanism of the "hinge" type coaxial tilting blades in various constructional variants.
Figure 80:
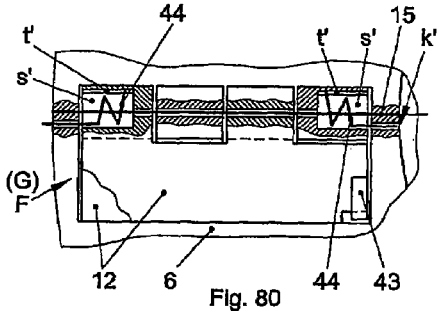
Figure 81:
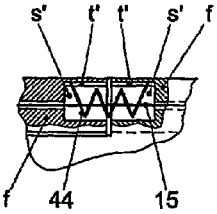
Figure 82:
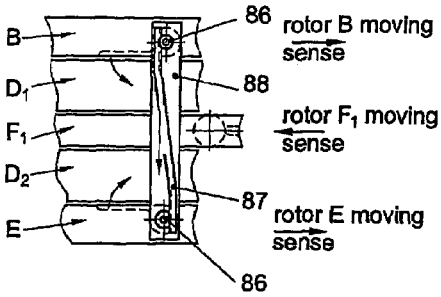
FIG. 82, 83—Detail of the synchronisation mechanism of the tilting blades driving at various stages, arranged on the rotor outside, in various constructional variants.
Figure 83:
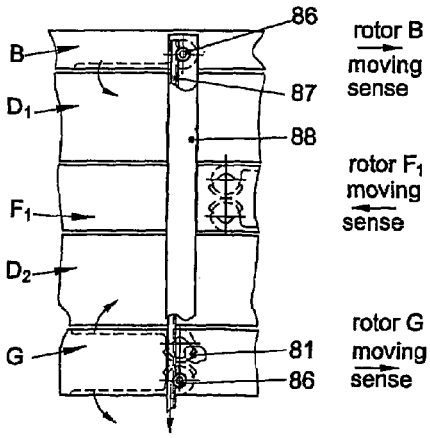
Figure 84:
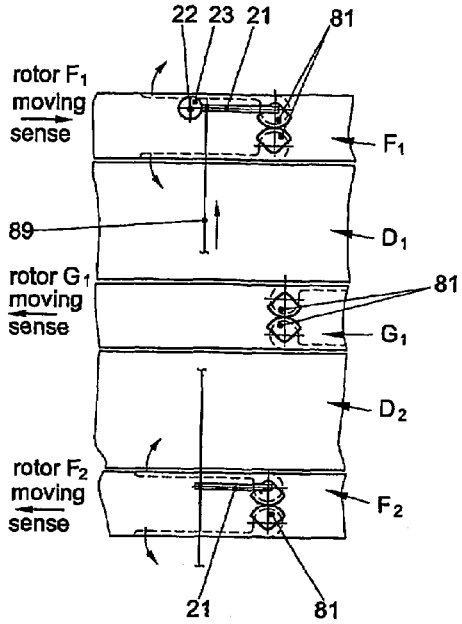
FIG. 84, 85—Detail of the synchronisation mechanism of the tilting blades driving at various stages, arranged inside the rotors, in various constructional variants.
Figure 85:
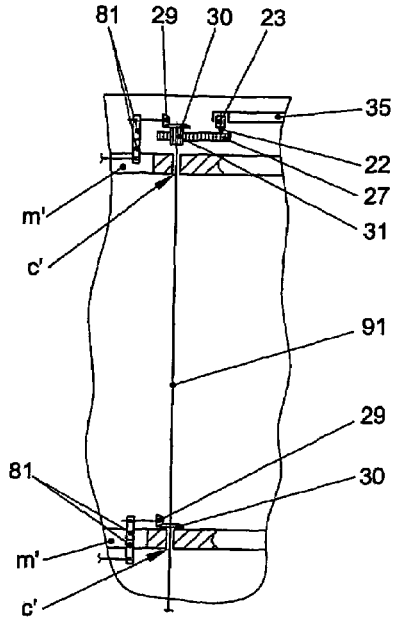
Figure 86:
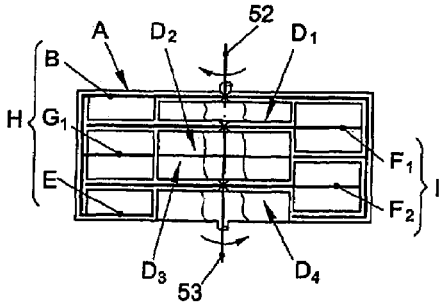
FIG. 86-88—Schematic cross section on 90°–270° centerline of a multistage machine with an even number of stages, in various constructional variants.
Figure 87:
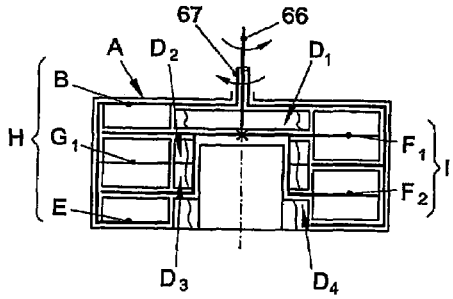
Figure 88:
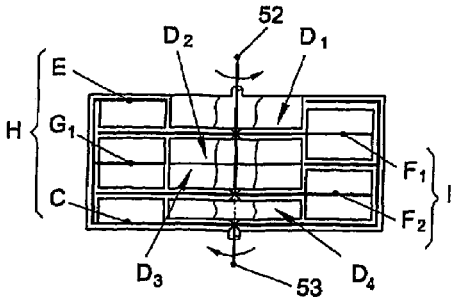
Figure 89:
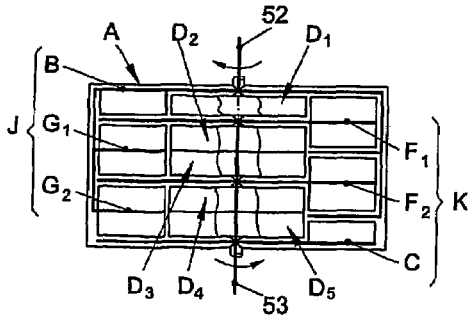
FIG. 89-91—Schematic cross section on 90°–270° centerline of a multistage machine with an uneven number of stages, in various constructional variants.
Figure 90:
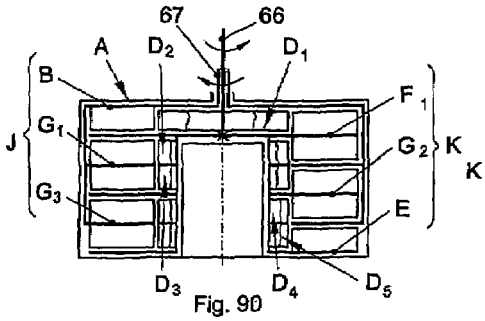
Figure 91:
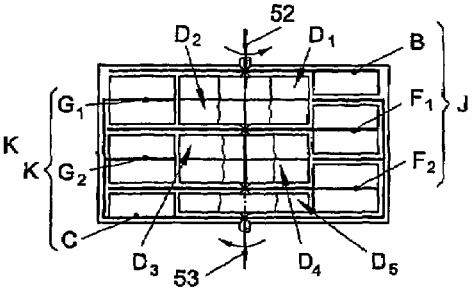
Figure 92:
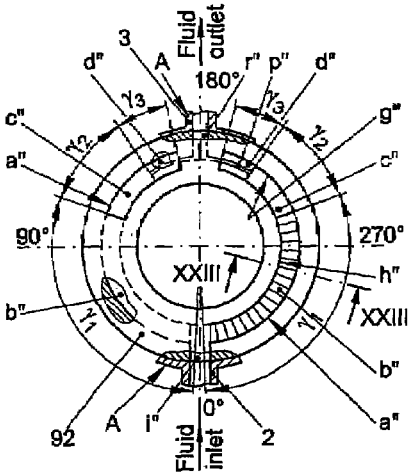
FIG. 92—Schematic front view of a cylindrical ring 92 according to a constructional variant, with an open a channel.
Figure 94:
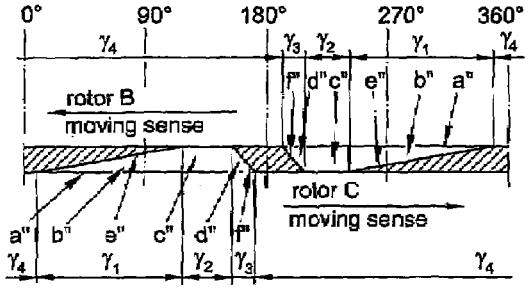
FIG. 94—Developed schematic diagram of the channel a profile in the cylindrical ring 92 according to the constructional variant with open channel.
Figure 93:
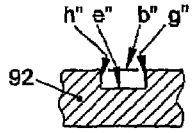
FIG. 93—Cross section to line XXIII—XXIII shown in FIG. 92.
Figure 95:
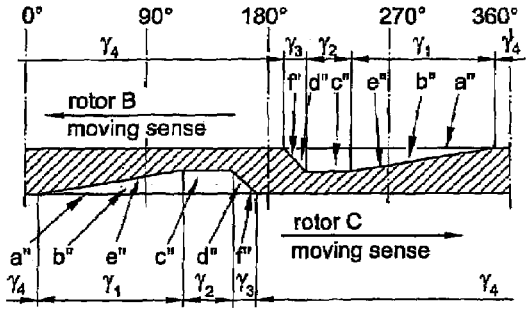
FIG. 95—Developed schematic diagram of the channel a profile in the cylindrical ring 92 according to the constructional variant with closed channel.
Figure 96:
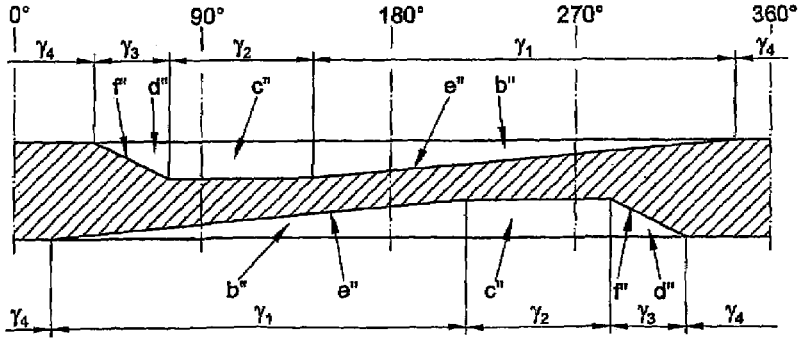
FIG. 96—Developed schematic diagram of the channel a profile in the cylindrical ring 92 according to the constructional variant with overlapped channels.
Figure 97:
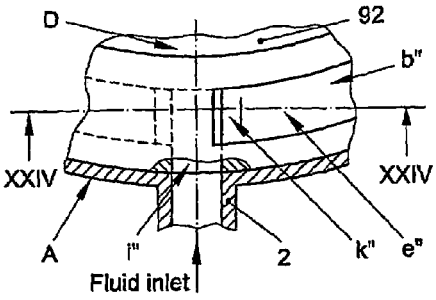
FIG. 97—Detail of fluid inlet according to a constructional variant.
Figure 98:
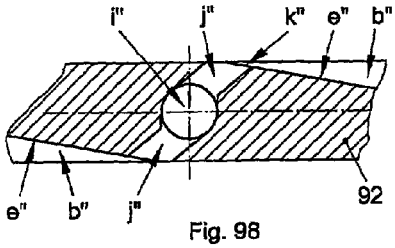
FIG. 98—Cross section to line XXIV—XXIV shown in FIG. 97.
Figure 99:
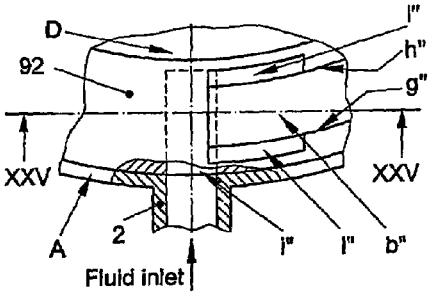
FIG. 99—Detail of fluid inlet according to other constructional variant.
Figure 100:
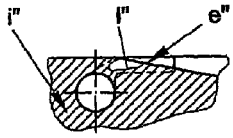
FIG. 100—Cross section to line XXV—XXV shown in FIG. 99.
Figure 101:
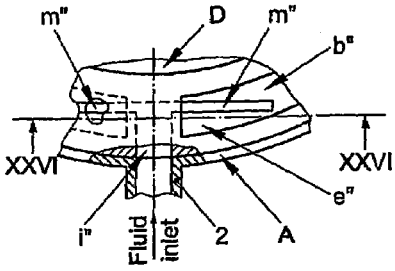
FIG. 101—Detail of fluid inlet according to other constructional variant.
Figure 102:
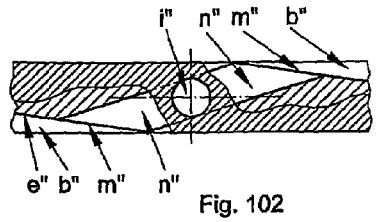
FIG. 102—Cross section to line XXVI—XXVI shown in FIG. 101.
Figure 103:
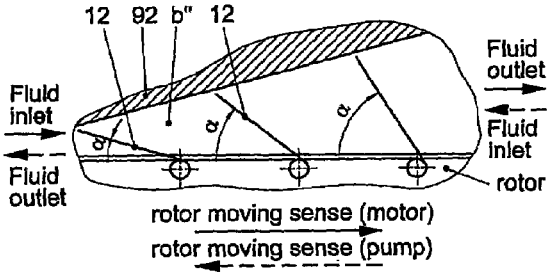
FIG. 103—Schematic diagram of the tilting blade 12 position in the zone having decreasing depth b of channel a according to two functional variants.
Figure 104:
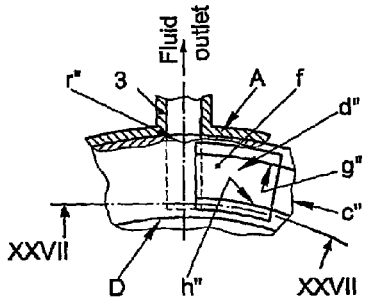
FIG. 104—Detail of fluid outlet according to a constructional variant.
Figure 105:
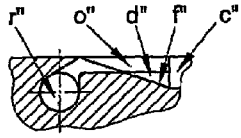
FIG. 105—Cross section to line XXVII—XXVII shown in FIG. 104.
Figure 106:
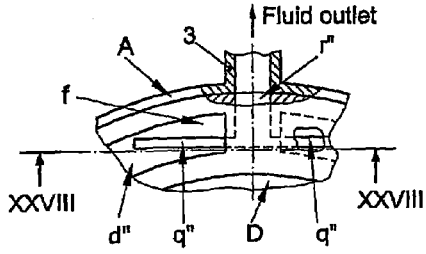
FIG. 106—Detail of fluid outlet according to other constructional variant.
Figure 107:
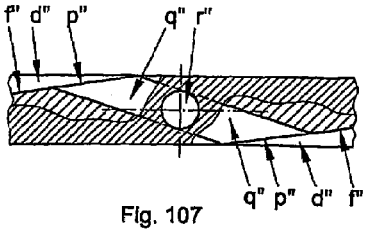
FIG. 107—Cross section to line XXVIII—XXVIII shown in FIG. 106.
Figure 108:
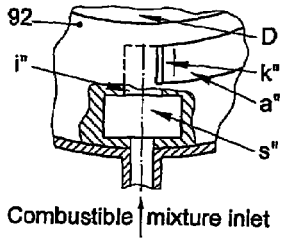
FIG. 108—Schematic diagram of fluid inlet, with incorporated combustion chamber, according to a constructional variant.
Figure 109:
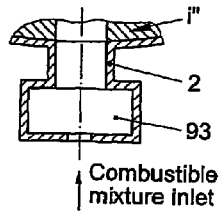
FIG. 109—Schematic diagram of fluid inlet connection to the outside combustion chamber, according to a constructional variant.
Figure 110:
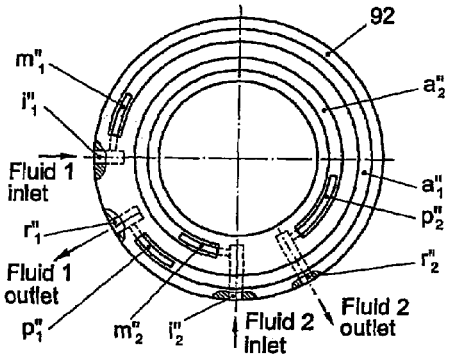
FIG. 110—Schematic front view of a cylindrical ring 92 with two independent channels $a''_1$, $a''_2$ on the same front face.
Figure 111:
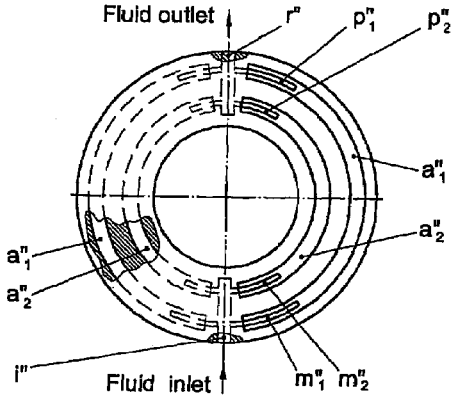
FIG. 111—Schematic diagram of a cylindrical ring 92 with two channels $a''_1$, $a''_2$ coupled, in parallel on each face.
Figure 112:
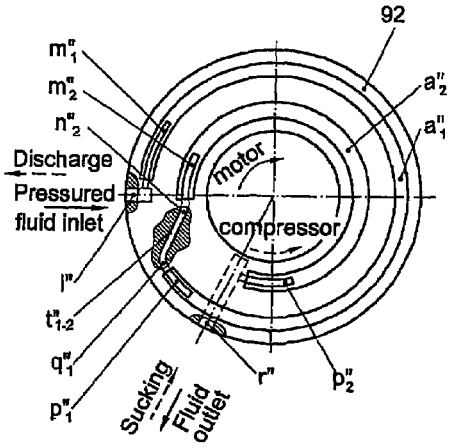
FIG. 112—Schematic diagram of a cylindrical ring 92 with two channels $a''_1$, $a''_2$ coupled in series according to two functional variants—motor or compressor (pump)
Figure 113:
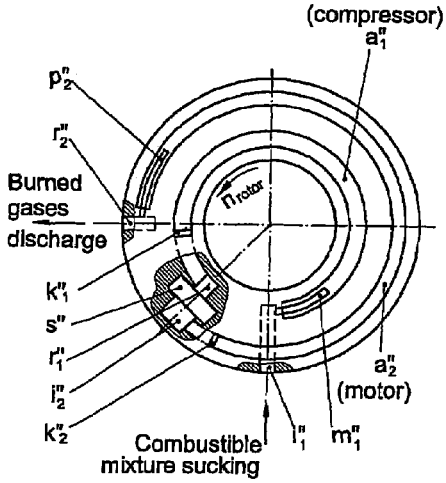
FIG. 113—Schematic diagram of a cylindrical ring 92 with the combustion chamber incorporated between two channels $a''_1$, $a''_2$ connected in series.
Figure 114:
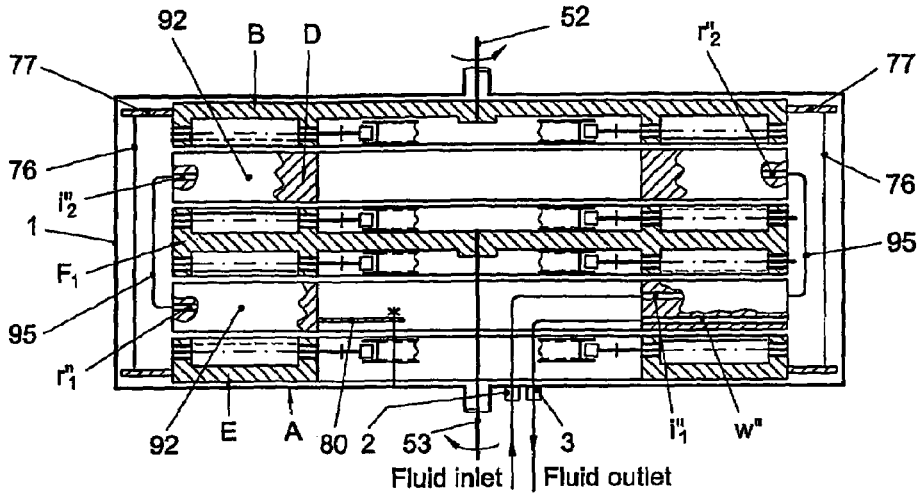
FIG. 114—Schematic section in vertical plane, of a hydraulic or pneumatic machine having channels with variable depth, according to a constructional variant.
Figure 115:
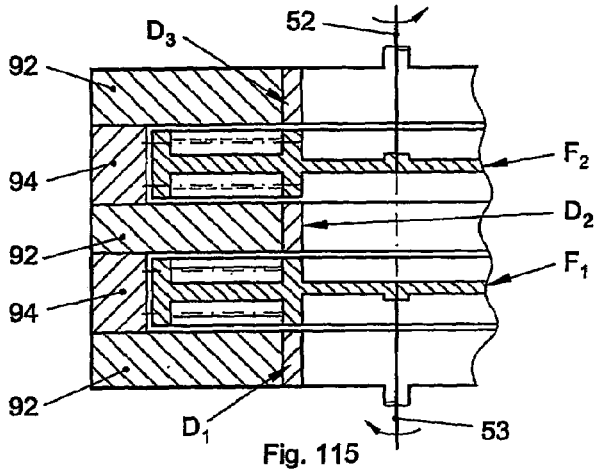
FIG. 115-117—Schematic section in vertical plane of a hydraulic or pneumatic machine, having channels with variable depth, with two stages, with axially balanced rotor, in various constructional variants.
Figure 116:
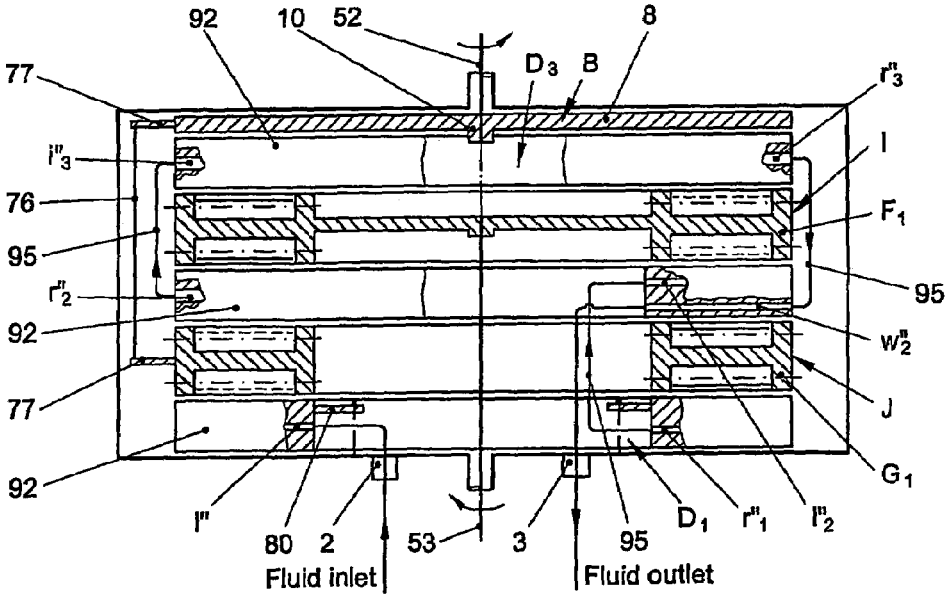
Figure 117:
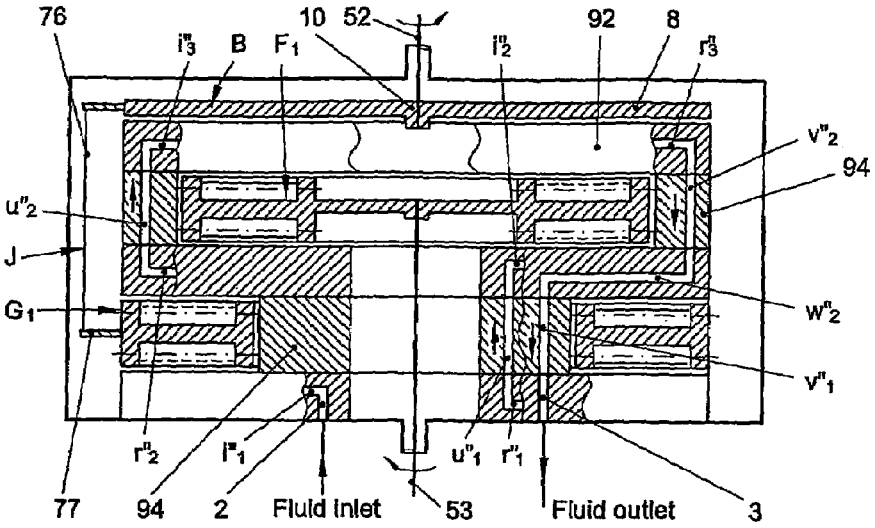
Figure 118:
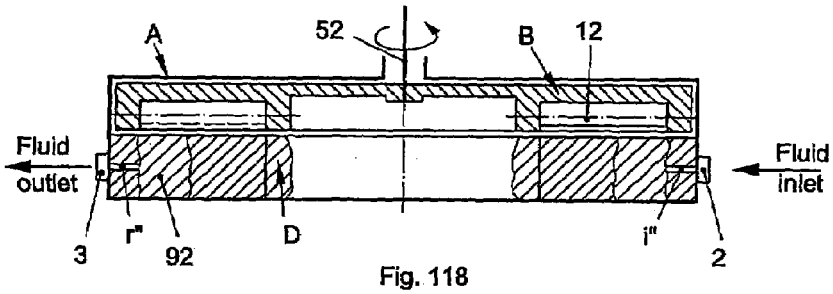
FIG. 118-120—Schematic section in vertical plane of a hydraulic or pneumatic machine, having channels with variable depth, with a single shaft, in various constructional variants.
Figure 119:
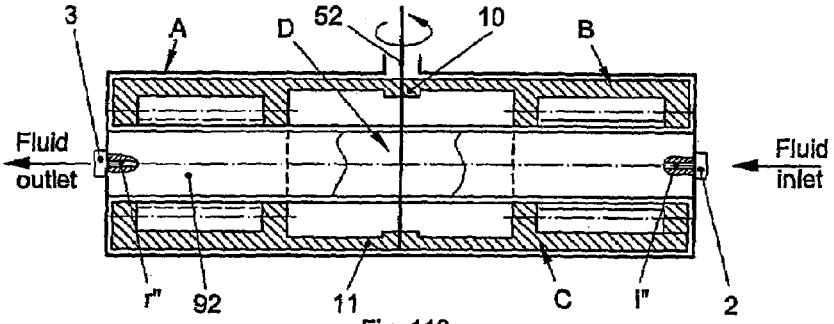
Figure 120:
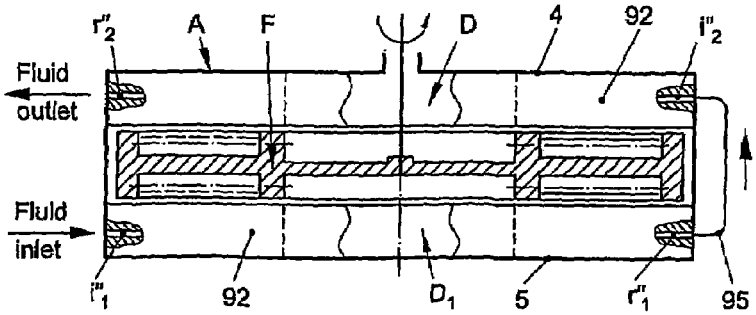
Figure 121:
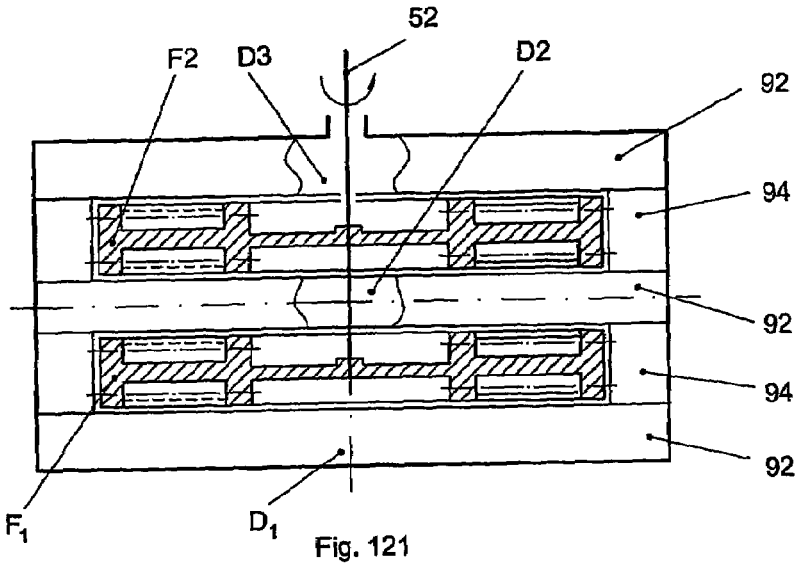
FIG. 121,122—Schematic section in vertical plane of a hydraulic or pneumatic machine, having channels with variable depth, with two stages, with axially balanced rotors, one outlet shaft, according to various constructional variants.
Figure 122:
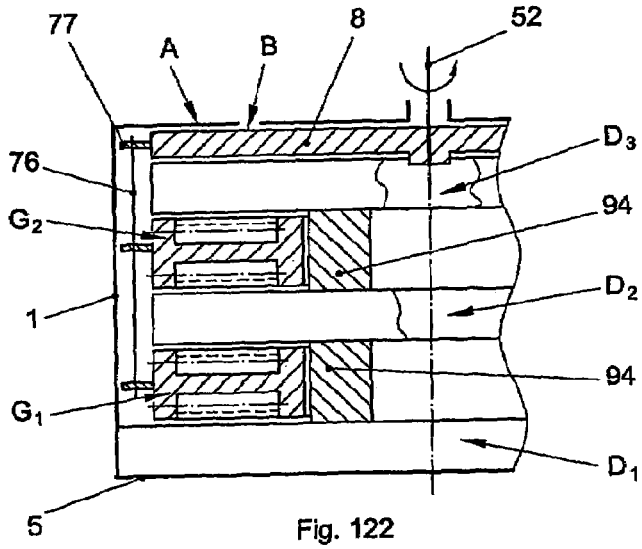
Figure 123:
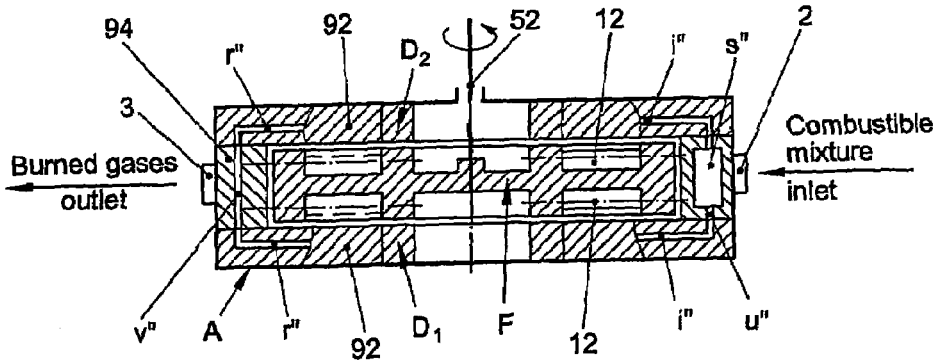
FIG. 123—Schematic section in vertical plane of a hydraulic or pneumatic machine, having channels with variable depth, balanced axial rotors, with the combustion chamber incorporated in the cylindrical ring 92, according to a constructional variant.

The hydraulic or pneumatic machine with vertical shaft made according to the invention consists of a fixed stator A, two disk like rotors, an upper one B and a lower one C, spaced from one another by a drum D connected onto stator A, all elements being in line, the parallel front faces of the two rotors being equipped with tilting blades which, due to some driving mechanisms of their own, can take against the rotor either a passive position—the blade in the front plane of the rotor, or an active position—the blade inclined by an $\alpha \leqq 90°$ angle against the front face of said rotor. Inside the machine, two symmetrical, semicircular channels a are formed and due to the manner the driving mechanisms are arranged within the machine, the blades of one rotor are in active position, obstructing the passage of respective channel while the blades of the other rotor are in passive position, so that the circulating fluid along the two channels a flowing to the same sense, actuates the blades found simultaneously in active position on the two rotors B and C and dictates their movement to opposite direction from one another, each rotor conveying the energy taken from circulating fluid to its shaft.

The stator A is made up of a cylindrical shell 1 locating on a radial direction, diametrically opposed a fluid inlet 2 and an outlet 3, a detachable upper lid 4 and a lower lid 5 in interdependence with the shell 1. The inlet 2 and outlet 3 are eventually in the form of convergent or divergent nozzle respectively. The height of the passage section of inlet 2 and outlet 3 nozzles at shell entrance, shall not exceed the distance between the front faces of the rotors B and C.

The upper B and lower C rotors are each made up of a flat ring plane 6 with identical, equally spaced, shaped grooves b, on the front surface delimiting channel a, secured to a frame 7 forming one part to a disc 8 and 9 respectively, provided with a hub 10, 11.

Some tilting blades 12 are hinged on each flat plane 6, in the shaped grooves b.

Each tilting blade 12 consists either of a rectangular or a distorted rectangular panel c with two opposite sides d and e, curves-arches of ellipse, as the blade in active position is perpendicular onto the front surface of the rotor or makes together with it an $\alpha<90°$ angle, having fastened on one of its straight sides a cylindrical hub f provided with a central orifice g.

The profile of the curve sides d and e is selected in such a manner as, when the blade is in active position, inclined by an angle $\alpha$ against the front face of rotor, all the points of the respective side be on the same cylindrical face.

The panel c has an upper flat face h, tangential to the hub face f and a lower flat face i, representing the active face of the blade on which, when in operation, the fluid exerts its pressure.

In other constructional variants, in view of making the blade a solid of equal strength and of improving the hydraulic efficiency of the machine, the lower face of panel c can be shaped to a curve i known in itself, or can be also provided with stiffening ribs k.

The groove b has a semicylindrical face l connected to the front face of the ring plane 6 by means of a flat plane m and a surface n shaped to the blade 12 shape. Each groove is delimited in the case of a rectangular blade, at the outward end, by a flat surface o provided with an orifice p and at the other end, a flat surface q with an orifice r. In the case of the blade with curve sides, d and e, the groove is delimited at the both ends by some is curve surfaces s and t respectively, with adequate profile.

The two orifices, p and r, are in line and serve to fix some radial or axial—radial bearings 13 and 14, known in themselves. Blade fastening into the bearings 13 and 14 of the rotor is achieved by a shaft 15 fixed in the orifice g of the blade hub by known means, not shown in the drawing, a shaft also used for blade actuation.

Each blade is directed together with its hub to the moving direction of the rotor it is mounted on, while the rotation axis of the blade, passing through the bearings 13 and 14 is either on the radial direction or it makes with the tangent to the inner circular outline of the plane 6, run to the piercing point of respective axis a $\beta<90°$ angle, with the vertex facing the rotor moving direction.

In a constructional variant, in the absence of plane 6, the rotor consists of an external stiffening ring 16 provided with orifices p, fixed on the frame 7 which in provided with orifices r, by means of rods 17, known in themselves, radial oriented, also meant as position limiters for the blades 12 found in passive position being shaped to the blade profile to this effect.

In case of large size rotors, in order to take over the axial loads due to their own weight, on the ring 16 of the rotor, between the bearings 13 of the blades 12, some equally spaced bolts 18 are fastened for the free rotation on them of same rollers 19 with spherical surface. The rollers of upper rotor B installed toward the outer side of ring 16 are guided between a flat ring surface u of a cylindrical gap v provided at the upper side of the shell 1 and the lid surface 4, while the guide rollers of the lower rotor C, installed toward the inner side of the ring 16 are supported on the lower lid 5 of the stator A.

In another constructional variant blade 12 is bracketed, resting only against bearing 14 on the ring 7 and having the outer end free. Position limiters 20 are provided on ring 7 for the passive position of each blade 12.

Each tilting blade 12 is provided with a driving mechanism, which can be built in several constructional variants, of elements known in themselves, the driving element of the blade being fastened on the end facing the inner side of the shaft 15.

According to a first variant, the driving element is a lever 21, the free end of which being provided with a fixed axle 22 on which a roller 23 moves freely. All the rollers 23 of the upper rotor B are guided between the upper guiding front surface w and the lower one x—of a fixed circular guide cam 24, whereas those of the lower rotor C between the front upper y and lower z guide surfaces of a fixed, circular cam 25. The two cams 24 and 25 have the same profile and are symmetrically arranged against the symmetry plane passing through the axis of inlet—outlet openings.

In another constructional variant, the driving element is a pinion 26 geared on a tappet with rack 27 provided at the end with a fixed shaft 22 with roller 23, guided by cams 24 or 25 respectively, the tappet being able to make a translation movement in a vertical guide a' or, according to another variant b', with a protection casing 28 of mechanism, fixed on the rotor, the position of the vertical guide against the pinion 26 determines both its rotation sense and therefore that of blade 12 during the translation movement of tappet, and the profile of cams 24 and 25.

According to another constructional variant, the driving element is a cone pinion 29 geared with a cone gear with vertical axis 30 in interdependence and in line with a cylindrical gear 31 provided with a spindle 32 which can freely rotate in the bearing c' of a protection casing 33 of the mechanism, fastened onto the rotor. The gear 31 engages with the rack tappet 27 provided with a fixed shaft 22 having the roller 23, the tappet being capable to execute a translation movement in a horizontal guide d' or, according to another variant e', of casing 33, the guide position to gear 31 determines its sense of rotation and therefore of the blade 12 during the tappet translation movement. All the rollers 23 of the upper rotor B are guided between some outer f' and inner g' radial, guiding surfaces of a fixed radial cam 34, while those of the lower rotor C, between the outer h' and inner i' guiding surfaces of a fixed radial cam 35. The two cams 34 and 35 have similar profiles and are symmetrically arranged against the symmetry plane running through the axis of inlet and outlet openings.

According to these variants, the two guide surfaces of each cam 24, 25, 34, 35 secure the closure of the cinematic chain of the blade driving mechanism.

According to other constructional variants, the cams have one guide surface each, closing of the cinematic couple of the blade driving mechanism being achieved either by the direct action of fluid pressure over the active surface of the blade, adequately shaped, or by additional elements, known in themselves, assuring the permanent contact of the roller with the cam surface.

Thus the roller 23 of the lever drive mechanism of the blade on the upper rotor B and lower rotor C respectively, is maintained under contact to the surface w of came 24 and surface z of cam 25 respectively, either due to a counterweight 36 installed on an extension i' of lever 21 in the case of upper rotor B or on lever arm 21, in the case of lower rotor C, or due to a spring 37, known in itself, installed in line with the tilting blade axis and twisted to the right sense so as to press the roller 23 on the cam surface, having one end fixed in an orifice k' provided in frame 7 and the other end resting in an orifice j' of lever 21. Under this variant, the blade tilting in active position during a full rotor rotation is secured by the profile of the contact surfaces w and z respectively, while resetting and keeping of the blade in passive position on rotor are secured by the said elements 36 or 37. The aperture angle of the blade in active position is limited by means of a stopper 38, known in itself, fastened onto the inner face of the rotor frame 7, having the role to limit the rotation of lever 21 arm j'.

In another variant, the roller 23 of the lever drive mechanism of the blade on upper B and lower C rotors respectively, is kept into contact with the cam 24 surface x and y of cam 25, either by installing a counterweight 36 on lever arm 21 for the upper rotor B, respectively on the extension j' of lever 21 for lower rotor C, or by a spring 37 twisted to the right sense. According to this variant, blade tilting in active position is assured by element 36 or 37 while resetting and keeping of the blade in passive position are assured by the profile of the contact surface x and y, respectively.

In other constructional variants, when blades 12 are driven by vertical or horizontal tappets, the permanent contact between the rollers 23 and the guide surfaces x and y of the cams 24 and 25 and g' and i' of the cams 34 and 35 respectively is maintained by means of compressed springs 39 installed in guides a' or b' and d' or e' respectively, under tappets ends.

The cams 24, 25 and 34; 35 respectively are fixed inside the drum D which is in line with the two rotors B and C, by means of ribs 40, known in themselves.

In another constructional variant, the cams 24, having the guide surface w and 25 having the guide surface z are located on the upper lid 4 and lower lid 5 respectively.

In this case casings 28 are installed with the guides a' or b' oriented to the rotors disks 8 and 9 respectively, provided with orifices m', corresponding to the associated guides for passing the tappets 27, their compression on the guide surfaces of cams being achieved by the springs 39 installed under compression in the tappets guides.

In case of tappets drive, the aperture angle of the blade is limited by the limitation of tappet stroke, chasing the suitable distance between its end and the guide bottom.

In another constructional variant, the tilting blades 12 of upper rotor B are guided by a front cam 41 with a guide surface n', while those of the lower rotor C by a front cam 42 with a guide surface o', both of them fixed in the fluid flowing channel a on the outer face of drum D, at its ends. The panel c of each blade is provided with a gap p' each, corresponding to the modified profile of the fluid flowing a channel, due to the existence of the two cams. On the surface h of the panel of each tilting blade, in the contact zone with the cam's guide surface, a skid 43 is fixed by known means with an r' end the shape of which suits the contact with the cam surface, eventually provided with a contact roller, known in itself, not shown in the drawing, located in gap p'.

The driving mechanism of each blade consists of lever 21 without roller 23, fixed on shaft 15, driven either by counterweight 36 or by spring 37, as previously described, in order to assure blade lifting in active position, its resetting and keeping in passive position being assured by cams profile 41 and 42.

In another constructional variant, the tilting blade 12 can either rotate freely on shaft 15 fixed on the rotor, in orifices p and r, or it is fixed on shaft 15 installed in bearings 13 and 14, the driving mechanism of the blade consisting of a twisting spring 44, known in itself, located in an orifice s' in line with orifice g, located at the end of the blade's hub f, one of the spring end being fixed in a gap t' existing in the wall of orifice s', while the other is fixed in the orifice k' of the rotor frame 7, so as the spring should be stressed in order to assure, during the rotor movement, the permanent contact between the r' end of skid 43 and the guide surface of the associated cam and consequently blade 12 lifting from passive position to active position on rotor, when the cam profile allows it.

In these variants, angle $\alpha$ is limited either by the position of cams 41, 42 against the front surface of respective rotor, for $\alpha<90°$, or by the surface m of groove b for $\alpha=90°$.

During a complete rotor rotation, each blade makes a rotation movement, being at the same time capable to take, due to its own driving mechanism, an active position, when the upper face h of blade is inclined by an angle $\alpha\leqq 90°$ against the rotor front face, or a passive position when the upper face h of blade is on the rotor front surface plane, being eventually located in the shaped groove b, or a transition phase from one position to other.

The angles described by a blade in one of the specific positions during a complete rotation of the rotor are marked by $\gamma$:

$\gamma_1$—the angle described during the transition phase of the blade from passive to active position;

$\gamma_2$—the angle described by the blade in active position;

$\gamma_3$—the angle described by the blade in the transition phase from active to passive position;

$\gamma_4$—the angle described by the blade in passive position; on condition that $\gamma_1+\gamma_2+\gamma_3+\gamma_4=360°$.

The size of angle $\alpha$ as well as the length of time for maintaining the blade 12 in one of the said positions, during a full rotor rotation, expressed by the value of angles $\gamma$ are determined by the cam profile of the blade driving mechanism. The profile identity of the two cams 24, 25 and 34, 35 or 41, 42 respectively determines equal values for the pairs of angles $\gamma$ specific to the two rotors, B and C.

Cams are fixed so as their guide surfaces should assure the symmetrical plane arrangement of angles $\gamma_1+\gamma_4$ specific to a rotor, against those specific to the other rotor, the symmetry plane running through the axis of stator A inlet—outlet openings.

The drum D consisting of a central body 45 with a cylindrical outer face having a deflector 46 and a rib 47, dyametrically opposed, provided with strengthening plates 48 and 49, is connected to the stator A of the machine by means of spacers 50 and some fastening elements like bolts, nuts, known in themselves, not shown on the drawing, so that deflector 46 and rib 47 be in the mentioned symmetry plane.

The deflector 46 has symmetrical lateral faces u' making a sharp angle between them, connected to the outer face of body 45 along its full height.

Blade 12 tilting, in active position, due to its own driving mechanism, can start only after the blade, in passive position on the rotor under rotation movement, outdistanced, with its entire outline, the projection of lateral surface u' of deflector 46 on the front surface of the associated rotor, while the return to passive position ends before the blade reaches near the rib 47. According to one constructional variant, deflector 46 is provided with gaps v', having a curved face, known in itself, permitting either the earlier start of blade tilting in active position, or deflector extension onto the angular zone $\gamma_1$.

Two symmetrical, semicircular channels are thus formed inside the machine, each channel having a rectangular passing section, defined by the front surfaces of the two rotors B and C, under a rotation movement in opposite direction to one another, the stationary inner face of stator A and the outer face of drum D.

In order to decrease hydraulic losses, the distance between the front surfaces of the two rotors as well as the diameters of shell 1 surfaces and of drum D body 45, are chosen function of blade 12 dimensions so as to secure minimum clearance from construction viewpoint between the walls of the machine semicircular channel and the edges of the blades, in active position, in the respective channel.

According to a constructional variant, when the blade does not reach the rotor outer edge, in order to reduce the clearance between the outer edge of the blade in active position on rotor and the cylindrical face of the casing A, a cylindrical segment 51 is fixed on stator, in each channel, between the front faces of the two rotors B and C, within the zone covered by angle $\gamma_2$.

The two channels a directly connected to the inlet and outlet openings, allow separation of machine incoming fluid into two equal streams flowing to the same direction.

By their profile and arrangement, the cams pairs assure blades 12 tilting, in active working position and the return to passive position of each rotor B and C, in one of the two channels a, so that, in each channel the blades of one rotor should be in active position, obstructing its section, while the blades of the other rotor should be in passive position.

The fluid working pressure in each channel exerted on the inner face covered by angle $\alpha$, of tilting blades 12 of one rotor, when the blades are in active position in respective channel, determines the rotor movement to the fluid flow direction and the occurrence of an engine couple at its shaft. Due to the fluid flowing to the same direction and to the symmetrical arrangement of the blades in active position on the two rotors, in the two machine channels, rotors B and C will move to opposite directions from one another, generating equal driving torque.

The number of tilting blades 12 on each rotor is selected in such a manner that between the fluid inlet and outlet openings should, at any time, be at least one blade in active position to obturate channel a, so as not to allow direct fluid circulation between the two machine openings.

Each rotor B and C by its 10 and 11 hub respectively, is fastened onto a shaft 52 and 53 respectively, through known means—wedges, grooves, etc.—not shown on drawings. The two in line shafts are supported against casing A by bearings 54 provided with sealing devices, all elements being known, in orifice w' on the upper lid 4 and orifice x' on the lower lid 5. The shaft ends rotating to opposite direction from one another get out of the machine on each side of it and can be coupled to a power consumer each, by means of known couplings, not shown on drawing.

According to a constructional variant, the machine has one outer shaft 55 parallel to the in line shafts 52 and 53 of rotors B and C, supported against an external bearing 56 connected on casing A by means of a support 57, all elements being known in themselves.

On rotor B shaft 52 and rotor C shaft 53 is installed one cone gear 58 and 59 respectively, in a mirror like arrangement, each one being engaged with a cone gear 60 connected onto the end of an intermediate shaft 61 supported in a bearing 62 on the upper lid 4 and the lower lid 5 of casing A, by means of a support 63.

The shafts 61, rotating to the same direction, drive by means of cone pinions 64 on the other end of the shafts some cone gears 65 an shaft 55, all elements being known in themselves.

In another constructional variant, the two in line shafts of the machine get out on one side, through one of the machine lids. To this effect, in case it gets out through the upper lid 4, the lower rotor C is mounted by its hub 11 onto a central shaft 66 whereas the upper rotor B is mounted by its hub 10 onto a tubular shaft 67 having a central channel y'. The tubular shaft 67 gets out through the central orifice of the upper lid 4, resting on it by means of a radial—axial bearing 68 also provided with a sealing device, all elements being known in themselves. The central shaft 66 rests on a radial—axial bearing 69, also provided with a sealing device, mounted in the central channel y' of a tubular shaft 67, according to one variant, it can additionally rest on a bearing 70 provided on the lower lid 5. In case the shafts get out through the lower lid 5, the upper rotor B is mounted on the central shaft 66 while the lower rotor C on the tubular shaft 67, its bearing 68 being mounted in orifice x' of the machine lower lid 5, the additional bearing 70 being eventually provided on lid 4.

On the external ends of shafts 66 and 67 are fixed the cone gear wheels 59 and 58 respectively, which rotate to opposite directions from one another and simultaneously engaged with a con pinion 71 on a machine driving shaft 72, determine its movement to one direction, the motor power at outlet shaft summing up the developed powers of the two rotors. The outlet shaft rests onto the lower lid 5, by means of a bearing 73 provided with a support 74, all elements being known in themselves.

In another constructional variant, the two in line shafts 66 and 67 represent the inlet shafts of a planetary reducer 75, known in itself, whose outlet shaft is coupled to a power consumer.

EXAMPLE 2

The hydraulic or pneumatic machine with vertical shaft, with multistage channels, made according to the invention, allows the circulation of a larger fluid flow, as compared to the one in the preceding example, by increasing the fluid passage section due to the use of several rotors of same diameter, namely: two extreme rotors with one front face each, provided with tilting blades 12, of which one, either the upper rotor B or the lower rotor C is mounted on one of the machine shafts and the other, a ring rotor E without supporting elements on machine shaft, and a number of disk F or ring G intermediate rotors with two front faces each, provided with tilting blades 12 on both faces, the blades on one face being mirror like arranged to those on the other face, their size and number being the same for the front faces of the rotors on each stage while they can vary from one stage to the other.

The tilting blades 12 of each rotor are arranged in such a manner as the neighbouring rotors move to opposite direction from one another, the distance between the rotors front faces representing the height of the fluid flowing channel a at each machine stage.

All rotors moving to one sense are rigidly coupled between them, making one package of rotors with the tilting blades 12 axes arranged on the same vertical planes so as inside the machine be two packages of rotors, moving to opposite senses from one another, each package being coupled to one of the two machine shafts, to which they convey the motion received from the working fluid.

The upper B and lower C rotors are similarly from constructional point of view to those given in the preceding example whereas the ring rotor E is different from constructional point of view only through the absence of the coupling elements on machine shaft-disk 8 or 9 respectively and the hub 10 or 11 respectively—and can be mounted, both in upper and lower position, depending on the constructional variant chosen.

The intermediate disk like rotor F consists of a flat ring plane 6 fixed, by means of disk 8, 9 respectively, onto hub 10, 11 respectively through which it conveys the motion to one of the two machine shafts: upper and lower ones, respectively.

The ring plane 6 has two parallel front faces provided with shaped grooves b made according to one of the variants described in the aforesaid example, each groove being provided with in line orifices p and r for the hinged fastening of blade 12 onto the rotor. The shaped grooves b on the front face of plane 6 are symmetrically—mirror like—arranged as compared to those on the other front face, all being arranged in such a manner as to secure the rotor, by the position of the tilting blade on respective surface, a rotation movement to the opposite sense of the two neighbouring rotors.

According to a constructional variant, the intermediate rotor F is made of a ring 16, concentrically attached to frame 7, interdependent to disks 8, 9 and hubs 10, 11 respectively, through the rods 17, eventually arranged radial and which can also serve as position limiters for blades 12 in passive position, shaped to this end according to blades profile. Both the ring 16 and the frame 7 are provided with coaxial orifices p and r respectively in order to mount the tilting blades pairs.

In another constructional variant, in order to reduce rotor F thickness, the rotor has the blades 12, located in opposite positions on the two front faces, installed either on a single shaft or on coaxial shafts, the rotor being in this case provided with one row of orifices p and r. The two tilting blades 12, each have the hub made of one or several elements f fixed on panel c edge and arranged along its entire length, alternatively with the ones making the hub of the pair blade thus making together a "hinge" type articulation, either loose on the shaft 15 if it is connected in the corresponding orifices p and r of the rotor, or connected by their hubs f, by known means, not shown on drawing, one directly on shaft 15 while the other—loose against shaft 15—fixed on a tubular shaft 78, in line with it, in this latter case, the corresponding p and r orifices of the rotor having installed the bearings 13 and 14 respectively, while the two shafts 15 and 78 are meant for mounting the blades driving mechanism. Under this variant, in the case of a rotor made up of a ring panel 6, the seat shaped for the installation of the in-line tilting blades pairs with coaxial hubs, results from crossing the opposite shaped grooves b on the respective front faces of the panel and is symmetrical to a plane containing the rotation axes of the rotor blades, made up of the plane surfaces m, the shaped surfaces n as well as the ending surfaces of the two grooves.

The intermediate rotor G, in the form of a ring similar from constructional point of view to the above described intermediate rotor F, is devoid of the coupling elements to one of the machine shafts—disks 8, 9 respectively and hubs 10, 11 respectively—being provided on both front faces with tilting blades 12 arranged in such a manner as to secure a rotation movement to the opposite sense of its neighbouring rotors.

The machine can be built in several constructional variants, having an even or uneven number of stages.

In a constructional variant, in the general case of a machine with an even number of stages and uneven number of rotors consequently, the two packages of rotors consist of:

one package H made up of extreme rotors, the upper rotor B and the ring rotor E loose against the machine shaft, with tilting blades on one face, among which it can be found, in the case of the machines with a number of stages >2, one or several intermediate rotors $G_1$, $G_2$ with tilting blades on both faces, all the rotors of the package being rigidly fixed to one another by means of longitudinal tie-bars 76, equally spaced, along parallel or concurrent directions, on the outer outline of the reeve rotors and provided with stiffening plates 77 and fastening elements—bolts and nuts—known in themselves, not shown on the drawing. The whole package of rotors is coupled, by means of hub 10 belonging to the rotor B, to one of the machine shafts, either to the outlet one, at the upper side of machine 52 or 67, or to the central shaft 66, when it gets out at the machine lower side.

In a constructional variant, the rotors package H is provided at its upper side, with a ring rotor E, loose against the machine shaft, whereas at its lower side it is provided with an extreme rotor C, by whose hub 11 the whole package of rotors is coupled to a shaft, either to the outlet one at the machine lower side 53 or 67, or to the central shaft 66, when it gets out at the machine upper side; in the particular case of a two staged machine, the rotors package H consists only of the two extreme rotors, without any intermediate rotor G:

a package I, consisting of one or several intermediate rotors $F_1$, $F_2$ . . . with tilting blades on both faces, each rotor being placed between two neighbouring rotors, belonging to the other package of rotors H and directly coupled, by its hub, to the other shaft, according to the constructional variant chosen for the rotors package H.

In a constructional variant, the rotors package I consists of one intermediate rotor in the form of a disk $F_1$, located in the machine in the vicinity of the extreme rotor B or C of the rotors package H, end a number of intermediate rotors in the form of a ring G, all the rotors of the package being rigidly fixed to one another by means of longitudinal tie-bars 76 and of fastening plates 77, equally spaced on the inner outline of the frame 7 of each rotor, inside the drums D the whole package of rotors being coupled to the machine shaft by the hub of the rotor in the form of a disk $F_1$, the form of the ring rotors G permitting the reduction of the gap inside the machine drums by shaping accordingly the lid 4 or 5 placed in the vicinity of the extreme rotor E of the rotors package H.

In another constructional variant, in the general case of a machine with an uneven number of stages >1—therefore, with an even number of rotors—the two packages of rotors are made up of the following:

a J package consisting of the upper rotor B, with tilting blades on one face and several intermediate rotors as rings $G_1$, $G_2$, having tilting blades on both faces, fastened to one another by means of tie-bars 76 and of fastening plates 77, the whole package being coupled by hub 10 onto the upper rotor B, to one of the machine shafts, either the outlet one at the upper side of the machine, 52 or 67, or to the central shaft 66, when it gets out of the machine at its lower side.

In another constructional variant, the rotors package J is made up of a number of intermediate rotors $G_1$, $G_2$ . . . and the lower rotor C, with tilting blades on one face, by whose hub 11, the whole package is coupled to one machine shaft: either to the outlet one, at the lower side of machine 53 or 67 or to the central shaft 66 when it gets out at the upper side of machine.

a package K consisting of the other extreme rotor with tilting blades on one face, the upper rotor B and the lower rotor C respectively, and one or several intermediate rotors $F_1$, $F_2$ . . . with tilting blades on both faces, intercalated between the rotors of the other package and directly coupled by its hub, each, to the other shaft of the machine, according to the variant chosen for the rotors package J.

In a constructional variant, the rotors package K consists of an intermediate rotor, as a disk $F_1$ located in the vicinity of the extreme rotor B or C of the rotors package J, several intermediate rotors in the form of a ring G and an extreme annular rotor E, all the package rotors being rigidly fixed among them by means of longitudinal tie-bars 76 and of fastening plates 77, equally spaced on the inner outline of the frame 7 of each is rotor, inside the drum D, the whole rotors package being coupled to the machine shaft by the hub of the rotor in the form of a disk $F_1$ whereas the lid 4 or 5 placed in the vicinity of rotor E of the package is duly shaped so as to reduce the gap created inside the drums D.

In the particular case of a one staged machine, the two rotors packages J and K are made up of one rotor each, either B or C, the constructional type being similar to that described under example 1.

Each machine stage, within the space farmed between the front faces of two neighbouring rotors, is provided with one drum $D_1$, $D_2$ . . . similar to that described in the previous example, equipped on its body 45 with the deflector 46 and the rib 47, diametrically opposed, whose extreme edge do not exceed the outline of said rotors.

All the drums $D_1$, $D_2$ . . . are arranged in the same position, with deflector 46 located in the symmetry plane of inlet nozzle and coupled to one another, making a package to be fixed onto one of the casing A lid of the machine. Fastening of the adjacent drums $D_1$, $D_2$ . . . to one another or of the whole package of drums to the casing lid is achieved either through the rotor outside, in case they are located on both sides of rotor directly coupled onto one of the machine shafts, or through rotor inside, in case they are located on both sides of a rotor coupled to the others at the outside, by tie-bars 76.

Thus, the drums D located on both sides of an F type rotor, directly coupled by its hub onto the machine shaft, are located to one another by rotor outside, using the fastening plates 48 and 49 respectively, in interdependence with deflector 46 and the rib 47 respectively, between which spacers 79 are mounted by means of fastening parts which are not shown on the drawing, all elements being known in themselves. Likewise, the whole package of drums is fixed on one of casing A lids by the outside of a rotor, directly coupled to the machine shaft by means of shorter spacers 50, located between the fastening plates 48 and 49 of the drum and the associated lid.

The shape and size of the fastening plates 48 and 49 as well as the location of spacers 79, 50 respectively, are selected in such a manner as to permit both the movement of the rotors directly coupled to the machine shaft and the movement of the rotors belonging to the other package, coupled at the outside, by means of tie-bars 76 while the clearance between the fixed parts and the moving ones should be minimum so as to diminish the hydraulic losses.

The drums D located on both sides of a rotor G coupled to the other rotors of the package it belongs to, at the outside, by means of tie-bars 76, are fixed among them by means of fastening rings 80 located inside the body 45 of the drum, in interdependence with it and by means of spacers 79 located between said rings, all elements being known in themselves. Likewise, the whole package of drums is fixed on one of casing A lids above a rotor coupled at the outside to the package of respective rotors by means of shorter spacers 50, located between the ring 80 and the respective lid.

The opposite tilting blades 12 located on the front faces of F and G type rotors having parallel rotation axes arranged in the same vertical plane can be coupled two by two by means of geared segments 81, permanently engaged, mounted on the ends of the two shafts 15 of the blades, in such a manner as, when driving one of them—further on called leading blade—the other blade—further on called led blade—should make an identical movement to the opposite direction, thus achieving the synchronisation of the movement of the blades located in the same vertical plane.

In the variant of F and G type rotors, having opposite tilting blades 12, on the two front faces mounted on in—line shafts, the synchronisation of the tilting movement of the two blades can be achieved by mounting on the two shafts 15, 78 some cone pinions 82 and 83 respectively, permanently engaged with a pinion 94 which, due to the fact it rotates freely on an axle 85 fixed on the rotor, has the role of reverting the moving direction transmitted from one pinion to the other, all elements being known in themselves.

The blades driving mechanism 12, similar to the one described in the previous example is installed at all machine stages on the shaft of each blade belonging to the extreme rotors B, C, E and on the shaft of leading blade belonging to rotors F, G having the blades on both front faces. The cams pairs 24, 25 or 34, 35 and 41, 42 respectively of the driving mechanism, made according to one of the variants described in the previous example, are mounted at each stage of the machine onto the associated drum D so that to assure the simultaneous tilting of the blades located on the same vertical generatrix of the respective package of rotors.

In another constructional variant, the machine is provided with one pair of cams 24, 25 or 34, 35 and 41, 42 respectively and the adequate driving mechanisms; according to those previously described, located only at the level of leading blades, either at the first or the last stage of machine, the movement being simultaneously transmitted from each of them to all the leading blades on the same vertical, on the other rotors making the package of respective rotors by synchronisation mechanisms consisting of elements known in themselves.

Thus, in the case of package H, J of rotors fixed between them at the outside by tie-bars 76 and plates 77, all the leading blades are provided with one pinion 86 fastened on shaft 15 end, outside the rotor, all the pinions 86 on the same vertical being engaged by means of a common rack 87 located in a casing 88, fixed at the periphery of the rotors making the said package, in such a manner as the motion transmitted from the blade of the first rotor, or, in a constructional variant, of the last rotor, is simultaneously transmitted, by rack 87 and by gear segments 81 or cone gears 82, 83 and pinion 84 to all the blades on the same generatrix of the rotors package.

In the case of the other package I, K, all the leading blades of the lower and upper levels respectively, of the rotors package are provided with a driving element, a lever 21, a pinion 26, or a cone pinion 29 engaged with a cone gear 30, similarly to the driving elements of the leading blades of the first and last stage respectively, mounted on the shaft 15 end, inside the rotor. For the simultaneous motion transmission to all the stages of the rotors package, the driving elements of the leading blades at the first stage or the last one respectively, are coupled to those of the blades located on the same vertical, at the other stages, by means of lining elements: a joint stem 89 hinged to levers 21 in order to make deforming parallelograms, or a joint vertical rack 90, simultaneously engaged with the pinions 26 from all stages, provided at its upper, or lower end with a shaft 22 and a roller 23 in contact to the surfaces of driving mechanism cam, or a joint shaft 91 on which are fixed all the cone gears 30 of the rotors package installed on the same vertical, the rotors disks making the package being provided with orifices m' and c' permitting the installation of said lining elements.

In the case of rotors F and G having opposite blades on the two faces, in line and loosely mounted on the shaft, the driving mechanism of each blade consists of cams 41 and 42 attached onto the drums D of each machine stage and of twisted springs 44 located in the orifices s' drilled in the hubs f of each blade, as described in the previous example. The orifices s' are drilled in the extreme hubs of the two blades, in such a manner as each blade be driven by spring 44 installed in the associated orifice s' and tensioned between its gap t' and a fixed point on rotor, that is orifice k' drilled in the frame 7 for one of the blades and orifice z' drilled either in the outer wall of groove b or in the ring wall 16 for the other blade.

In a constructional variant orifices s' are drilled in two neighbouring hubs located face to face so that the two blades be simultaneously driven by one spring 44 installed in the seating formed of the two orifices s' and tensioned between their gaps t'.

EXAMPLE 3

The hydraulic or pneumatic machine with tilting blades, according to the invention, for working fluids under static pressure.

In view of adjusting the machine to run as a hydraulic or pneumatic motor using a working fluid under static pressure, in the circular space between the cylindrical shell 1 of stator A and the cylindrical body 45 of drum D, interdependent to it, is fixed a cylindrical ring 92 with the height corresponding to the distance between the front surfaces of rotors B, C, having on each front face of it a channel a" of variable depth, for the action of the tilting blades 12 of the rotor close to said surface, the two channels connecting the fluid inlet and outlet nozzle, diametrically opposed, each having an initial zone b", with a depth increasing to the rotation sense of said rotor, on the angular sector $\gamma_1$ specific to blade transition from passive to active position, a middle zone c" open to the other rotor, with constant depth, equal to the height of the cylindrical ring 92, on the angular sector $\gamma_2$, specific to keeping the blade in active position on rotor, and a terminal zone d", with decreasing depth, on angular sector $\gamma_3$, specific to blade transition from active to passive position.

The bottom of channel a" in the zones with increasing depth b" and decreasing depth d" consists of some shaped surfaces e" and f" respectively, similar to the surfaces generated by the edge of blade panel parallel to its rotation axis, at the movement of said tilting blade through the channel, on the angular sector $\gamma_1$ and $\gamma_3$ respectively, whereas the lateral walls of the channel consist of an external shaped surface g" and an internal shaped one h", similar to the surfaces generated by the other edges of the blade panel, in such a manner as the interspace between the shaped surfaces of the channel and the corresponding blade edges should have minimum values during its whole evolution in the said channel.

The two channels a" can be served by separate inlet 2—outlet 3 nozzles or by jointly shared nozzles.

The connection between the inlet nozzle 2 on shell 1 of stator A and each of the two channels a" is achieved either separately, by a radial channel i" in the cylindrical ring 92, provided with a branch j" communicating to a slot k" drilled in the shaped surface e" of the initial zone b" of the channel, or by a joint radial channel i", connected to both branches j". According to other constructional variants, the connection between the radial channel i" and each channel with variable depth a" is achieved either directly by some slots l" made in one or both lateral faces—the outer one g" and the inner one h"—on one portion or along the entire initial zone b" of said channel, or by a groove m" with variable or constant depth, executed on the bottom surface e" on one portion or along the entire initial zone b", communicating to the radial channel i" by its branch n".

The connection between each channel with variable depth a" and the outlet nozzle 3 is achieved either by slots o" drilled on one or both lateral surfaces—outer g" and inner h" one, over the entire length of the terminal zone d" of the channel or by a groove p" with variable or constant depth, executed along the bottom surface f" of terminal zone d', connected to a slot q" located on an extension of said channel, the two slots q" being able to merge so that the channels with variable depth a" on the two front faces communicate to each other, the cylindrical ring 92 being provided with one or several radial channels r" making the connection between the said slots o", q" and the outlet nozzle 3.

According to a constructional variant, the distance between the front faces of the two rotors B, C can be increased, without modifying the tilting blades dimensions 12, by adequately increasing the heights of the cylindrical ring 92 and of drum D, the channels a" having the depth correlated to the height of the blade in active position on the associated rotor and being closed all along their entire length.

In another variant, if the height of cylindrical ring 92 exceeds the sum of the depths of the two channels a" the length of their shaped zone can be increased so that for each channel:

$$\gamma_1+\gamma_2+\gamma_3>180°,$$

the plan projections of the two channels overlap over a certain portion while the orientation of the driving mechanism cam of the tilting blades of each rotor B or C corresponds to the plane position of the respective channel a".

In other constructional variants, either the terminal zone d" of channel a", closed or open, has a constant depth along its whole length, equal to that of the middle zone c", being eventually devoid of the discharge groove p" and communicating directly to slot q", located on an extension of said channel, connected to outlet nozzle 3, or the channel a" is devoid of the middle zone c" with constant depth, the initial zone b" being directly connected to the terminal zone d".

Thus, inside each channel a" of the cylindrical ring 92, between the adjacent tilting blades 12 of each rotor, are formed some mobile compartments, demarcated from the active and passive surfaces of said blades, the rotor front face and the faces of channel a" over the portion covered between the two blades, the volume of said compartments being variable due to the blades motion along the channel, on its variable depth zones—the initial b" and eventually the terminal zones d"—and constant on its middle zone c".

In view of diminishing the losses due to leaks, the front surfaces of the cylindrical ring 92 can be provided with baffles or sealing labyrinths, known in themselves, not shown on the drawing, arranged on one or both edges of the channel a", concentrically with the channel and, eventually, at one or both ends of the said channel, to a radial direction.

In the functional variant as pneumatic motor, the working fluid is either gas or pressure steam coming from an external storage tank, known in itself, not shown on the drawing, or gases coming from combustion fuel into a combustion chamber 93 outside the motor, known in itself, or into a combustion chamber s" located inside the cylindrical ring 92, both equipped with feeding devices for the formation of fuel mixture and its ignition, all known in themselves, not shown on drawing and connected by one or several radial channels i" to the channels with variable depth a".

Along the zone with increasing depth b" of channel a", the pressure in each moving compartment between two successive blades, varies with the increase of its volume, from a maximum feed value, in the compartments directly connected to the fluid inlet nozzle, or by slot k" or slots l" or channel m" executed on part of the said zone, to a minimum value, at the end of the initial zone b" and on the middle zone c" with constant volume compartments, while subsequently, on the terminal zone d", due to the direct connection of each compartment to the outlet nozzle 3 either through slots o" or through the grooves p", slots q" and channels r", the pressure decreases to the value of the motor outlet pressure.

Each compartment located on the initial zone b" of the channel, containing the working fluid under a certain pressure, borders, any time, upstream on a compartment with lower volume and higher pressure and downstream, on a compartment with higher volume and lower pressure so that the total pressure drop over the entire initial zone b" occurs in a number of pressure stages equal to the number of compartments located at a certain time in the said zone of the channel, the pressure drops from one compartment to the other through the interstices between the tilting blades and the channel walls they move in, being diminished due to the low pressure difference existing between the said compartments.

The driving forces causing the rotor movement manifest themselves in all the compartments located in the initial zone b" of the channel acting upon the active surfaces of said blades and having values proportional to the fluid pressure in the compartment and to the depth difference of the channel, measured at the top ends of the two blades delimiting the compartment, the torsion moment of the rotor shaft being the sum of the moments given by all said forces.

In other variants, as hydraulic motor, feeding is done by a pressure fluid, either through the slots l" or the groove m" executed along the entire length of the initial zone b" of the channel a", the liquid pressure being almost constant in all compartments with growing volume. The liquid discharge from the motor starts at the same time with the motion of the tilting blade on the terminal zone d" of the channel, the said compartment being connected either by slot o" or by groove p" on this zone to the outlet nozzle 3. The driving force acts on the tilting blades 12 located in the middle zone c" of channel a" due to the liquid pressure difference in its two neighbouring zones b", d".

In a constructional variant, driving each rotor by a driving moment applied on its shaft in such a manner as the tilting blades 12 should travel through the channels with variable section a" to opposite sense—the vertex of the angle between the blade and the front face of the rotor oriented to the opposite sense of rotation—the previously described machine runs as a hydraulic pump or compressor. The working fluid flows in channel a" to the sense the rotor blades move, being sucked in the terminal zone of the channel d" either by slot o" or by groove p" and slot q", connected to nozzle 3 which became a suction nozzle due to the volume increase in the mobile compartments formed on the rotor when travelling through this zone and discharged by nozzle 2 which became a discharge nozzle, at a pressure higher than the suction one, after being previously compressed eventually—in case of operation with compressible fluids—due to the volume decrease of the said compartment when travelling through the initial zone b" of the channel.

In other constructional variants, the machine rotors have one or several concentric rows of tilting blades 12 which may differ among them, from one row to the other or from one rotor to the other, in terms of shape, dimensions and position on rotor, each row of blades being provided with a driving mechanism of its own, according to previous examples. On the front surface of the cylindrical ring 92, close to the front surface of the respective rotor, there is a corresponding number of concentric channels $a''_1$, $a''_2$ . . . with variable depth, which can be independent—with inlet and outlet nozzles of their own—or coupled between them, on the same or different faces, either in parallel—with joint inlet and outlet nozzles for several channels—or in series, one in continuation to the other, so that the fluid flows the whole way from inlet to outlet, through one or several channels, to the moving direction of the tilting blades 12, the plane orientation of the cams driving mechanisms of each row of blade being correlated to that of channel a" wherein the said blades act while the two outlet shafts of the machine, coupled to rotors B, C can rotate to the same or to opposite senses.

Each channel $a''_1$, $a''_2$ on the face of the cylindrical ring 92 can be framed by baffles or sealing labyrinths, elements known in themselves, not shown on drawing, in order to diminish the pressure losses to the outside or to the neighbouring channels.

Several constructional variants are possible due to the position of the tilting blades 12 on the rotor faces, as defined by the orientation of the angle vertex a formed between the said surface and the blades, against the rotor moving sense, position which can be the same for all rows or may differ from one row to other.

Thus, locating the tilting blades 12 on several concentric rows, id est two, in the same position, with the angle vertex $\alpha$ to the rotation sense of the rotor, and the corresponding concentric channels $a''_1$ and $a''_2$ respectively, one in the continuation to the other, coupled in series by an intermediate shaped channel $t''_{1-2}$, connecting the slot $o''_1$ or $q''_1$ of the terminal zone $d''_1$ of the first channel $a''_1$ and the slots $k''_3$ or $l''_2$ or $n''_2$ of the initial zone $b''_2$ of the other channel $a''_1$, the pressure gas gets in by the motor inlet nozzle 2 into the initial zone $b''_1$ of the first channel $a''_1$ passes successively through the two channels—acting on the tilting blades of the two rows, found in active position due to their own driving mechanisms, duly oriented—and goes out of the motor by the discharge nozzle 3 connected to the terminal zone $d''_2$ of the other channel. By choosing the due dimensions of the channels $a''_1$ and $a''_2$ and the right number of tilting blades 12 on each row, a continuous volume increase may be secured for the compartment located between two successive blades and consequently the prolonged expansion of the working fluid the whole way through, from the circuit inlet to outlet, causing the occurrence of some moving forces which act over the blades located in the initial zone $b''_1$ and $b''_2$ of both channels.

According to one constructional variant, by acting each rotor by a driving moment applied on its shaft so that the tilting blades run through channels $a''_1$ and $a''_2$, coupled in series, to opposite sense, having the angle vertex $\alpha$ in the opposite sense of the rotor movement, the working fluid is sucked by the nozzle 3 of the terminal zone $d''_2$ of channel $a''_2$ which it is connected to, runs through the two channels, driven by the tilting blades 12, being compressed, due to the continuous volume decrease of each compartment in the said channels and gets out by the nozzle 2 connected to the initial zone $b''_1$ of the other channel $a''_1$, the machine running as a compressor.

In other constructional variants, the cylindrical ring 92 surface may have simultaneously independent channels a" as well as channels connected in parallel or in series, making separate circuits, each circuit running according to the orientation of the respective tilting blades against the rotor, either as an engine or a pump, with the same fluid or different ones. Thus, according to one constructional variant, a pumping circuit achieved with one or several channels a" supplies air or a fuel mixture under pressure to an outside combustion chamber 93 or a combustion chamber s" located in the cylindrical ring 92, whence, the gases resulted from combustion circulate through other channels a", setting into motion the respective tilting blades of the rotor, part of the generated energy being used for the feed mixture compression.

In other constructional variants, the hydraulic machine is multistage, according to example two, the rotors with the same diameter or those with different diameters having the tilting blades arranged on one or several concentric rows, the drum D of each stage having fixed a cylindrical ring 92 provided with channels a", with corresponding variable section, which can be coupled between them on each stage, as previously described, or between stages, in such a manner as to make inside the machine, either one circuit running as an engine or a pump (compressor), or several circuits of which some are running as an engine while the other are running as a pump (compressor), using one or several working fluids.

The cylindrical rings 92 located on both sides of the rotor faces are fixed in interdependence to the respective drums D either by means of fastening ribs 48 and rings 80 respectively as well as of some fastening elements—such as bolts, nuts, etc.—or by some space rings 94 located between the two neighbouring cylindrical rings 92, concentrically to them—either outside the disk rotors F or inside the ring rotors G—holding being achieved by bolts and nuts, known in themselves, not shown on the drawing—the space rings 94 can be provided with channels u" and v" connected to the inlet channels i" and the outlet channels r" executed into the neighbouring cylindrical rings 92.

The tilting blades on each front face of the intermediate rotors F, G are driven either by a common mechanism, according to previous examples or by a mechanism of their own, dismissing eventually the permanent coupling of the tilting blades located on the opposite faces of a rotor, by geared segments 81, the plane orientation of the cams pairs of the independent driving mechanism of each stage can be different in this variant, from one stage to another, according to the orientation of the channels with variable section a" wherein the tilting blades move on the respective stage and row.

In the case of the fluid circuits extended over several stages of the machine, the coupling of the channels a" located on different stages is done by some pipes 95, known in themselves, which sake the connection between the radial inlet channels i" and respectively the radial outlet channels r" of channels a" from one stage to those of the next stage, according to the chosen connections plan.

In the case when, in order to make a circuit by coupling the channels from one stage to those of the other stage or to the inlet or outlet nozzles of the machine, it is necessary to cross one or several intermediate stages, their cylindrical rings 92 are provided with radial channels w", coupled to the associated connecting pipes 95.

The connecting pipes 95 are located either outside the cylindrical rings 92 or inside the drums D, similarly to the fastening elements of the neighbouring drums D as they frame a disk rotor F or ring rotor G respectively, the position of inlet radial channels i" and outlet channels r" respectively—to the outside or the inside of the cylindrical ring 92—being chosen so as to suit the position of the respective pipes. The machine inlet—outlet nozzles respectively and the connecting pipes 95 coupled to them are located on the circular ring 92 being part of the drum D which is directly fitted on the machine casing, their number corresponding to the number of the existing fluids circuits and to their way of coupling.

In other constructional variant, the connection between the channels a" of the various stages can be achieved by the channels u" and y" existing in the spacing rings 94.

In other constructional variants, in order to reduce the axial forces resulted in the shafts bearings, the machine has only rotors with tilting blades on both faces, either two disk rotors F, each coupled to one of the outlet shafts, or a package I made up of disk rotors F, each coupled directly to one of the machine shafts and a package J made up of ring rotors G and an extreme rotor B or C, devoid of tilting blades on its front face, used only for coupling the whole package to the other machine shaft by its disk 8 or 9 respectively, extended to the rotor periphery and its hub 10 or 11 respectively, belonging to it. The cylindrical rings 92 fitted onto the drums D of each stage have channels a" with variable depth on one or both front faces as they occupy inside the machine an extreme position, bordering one surface of rotor F, G or an intermediate position, between the surfaces provided with tilting blades of two neighbouring rotors F, G.

In the particular case the tilting blades on the two front faces of each rotor are identical, as shape and arrangement, and the fluids pressures in the corresponding channels a" on the cylindrical rings 92 are equal, the resulting axial force acting on the rotor is null.

In other constructional variants, the hydraulic machine can have only one upper outlet shaft 52 or a lower one 53.

Thus, in a constructional variant, the extreme rotors B and C are fastened by their hubs on the same outlet shaft of the machine, the orientation of the tilting blades on the front faces of the rotors and that of channels a" on the front faces of the cylindrical ring 92 being selected so as to make both rotors move to the same sense.

In other constructional variant, the hydraulic machine has one extreme rotor B or C, provided with one or several rows of tilting blades 12, the cylindrical ring 92—having, accordingly, one or several channels a" on the surface adjacent to the rotor—being fitted on the lid 5 or 4 opposite to the respective rotor.

In another constructional variant, in order to reduce the resulting axial force acting on the shaft, the hydraulic machine has one rotor with tilting blades 12 on both faces, similarly to the disk type intermediate rotor F, previously described, installed on its shaft 52 or 53 and two cylindrical rings 92 fitted on the lids 4 and 5 of casing A, on both sides of the rotor, provided on their front faces with the channels a", having variable depth, corresponding to the rotor tilting blades, separated or coupled to one another, in series or in parallel.

In a variant, the hydraulic machine has several disk rotors F with tilting blades 12 on both faces, fastened on a joint shaft 52 or 53, spaced from one another in the form of a package of rotors I and a corresponding number of cylindrical rings 92 with channels a", having the shape and dimensions adequate to the blades of the associated rotor, located either on one front face—in the case of the those located at the ends of the rotors package and fitted on upper 4 or lower 5 lids—or on both front faces—in the case of those located between two neighbouring rotors, eventually fixed on the cylindrical shell 1 of stator A.

In other constructional variants, the machine has one or several rotors with tilting blades 12 on both faces, similarly to the ring type intermediate rotor G, previously described, and an extreme rotor B or C, devoid of tilting blades on its front face, all making a package of rotors J installed on the outlet shaft 52 or 53 by the disk 8 or 9 extended to the periphery of the extreme rotor and its hub 10 or 11.

The invention claimed is:

1. A hydraulic or pneumatic machine with vertical shaft, with tilting blades, characterized by the fact that, in view of converting the energy of a pressure fluid or of a fluid stream into mechanical energy and in view of achieving a symmetrical fluid circulation in the machine, consists of a stator (A) made up of a cylindrical shell (1) provided with two openings radially arranged to diametrically opposed directions—one for fluid inlet (2), eventually in the form of a convergent nozzle and one for fluid outlet (3), eventually in the form of a divergent nozzle and two fixed or detachable lids—an upper (4) and a lower (5) one; two coaxial rotors rotating to opposite senses from one another—an upper one (B) and a lower one (C)—in form of disks, with parallel front faces, each consisting either of a flat ring plane (6) provided on its front face, with several shaped grooves (b), equally spaced, wherein some tilting blades (12) are installed, or an external stiffening ring (16) provided with orifices (p) for the blade bearings, with of rods (17), known in themselves, radially arranged, also used as position limiters for the tilting blades (12) in passive position on the rotor, being shaped for this purpose to the blades profile, coupled by means of a frame (7)—for the upper rotor (B)—to a disk (8) provided with a hub (10), fastened by elements known in themselves, onto an upper outlet shaft (52)—for the lower rotor (C) respectively —to a disk (9) provided with a hub (11) fixed on a lower outlet shaft (53), the two shafts getting out either each through the lid adjacent to the respective rotor through some central orifices (w', x') of the lids (4, 5) respectively being supported in some radial—axial bearings (54) also provided with sealing elements, known in themselves, or get out through the same lid of the casing (A), either the upper (4) or the lower (5) one, the rotor adjacent to the respective lid being fixed onto a tubular shaft (67) having a central channel (y') getting out through the central orifice (w'), (x') of the respective lid, resting on it by means of an axial—radial bearing (68) also provided with a sealing device, the other rotor being fixed on a central shaft (66) resting both in an axial - radial bearing (69), provided with a sealing device, mounted in the central channel (y') of the tubular shaft (67) and, eventually, in an additional bearing (70) provided on a lid in its vicinity, the outer ends of the shafts being capable to be coupled to a power consumer each or among them, through known means, in order to covey the motion to one outlet shaft (55, 72 respectively); a number of tilting blades (12), each consisting of a rectangular panel (c) or a panel having the shape of a distorted rectangular, with two opposite sides (d, e) in the form of an ellipse arc, with a plane upper face (h) and a lower face, either plane (i) and parallel to the upper one, or curve (j), eventually provided with stiffening ribs (k) and a cylindrical hub (f) the outer face of which is tangent to the upper face (h) of the panel, provided with a central orifice (g) fitted with a shaft (15), each blade (12) being fitted either in a groove (b), duly shaped to the lower face of the tilting blade, bordered at the outer end by a plane surface (o) or curve surface (s) provided with an orifice (p) and at the other end by a plane surface (q) or curve surface (t) respectively with an orifice (r), the two orifices being coaxial meant to fasten some radial or axial—radial bearings (13) and (14) respectively, known in themselves, for hinged connecting of the blade (12) by means of the shaft (15), or between the external ring (16) and frame (7) provided with radial bearing (13) and (14) respectively, or in the absence of the external ring (16), the tilting blades (12) are bracketed only in bearings (14) installed on the internal frame (7) of the rotor, also provided with position limiters (20) for blade support in passive position, the blades (12) being arranged on the front face of each rotor, radial, or so that the axis of each tilting blade makes with the tangent to the inner circular outline of the plane (6), drawn to the intersection point of respective axis, a $\beta<90°$ angle with the vertex facing the rotor moving sense, so that each blade (12) should have the hub located to the moving sense of the respective rotor; one driving mechanism for each blade (12) constituted from a simple cinematic chain, made up, in different constructional variants, from known in themselves elements, e.g. a lever (21) either a gearing or a gearing with a rack tappet, which makes the coupling between the tilting blade shaft (15) or, in other constructional variant, directly between the tilting blade (12)—which can freely rotate on its shaft and an element—either a roller (23), or a skid (43) located on the tilting blade (12) upper face into contact with one or both guiding faces of the cam corresponding to the respective rotor, so that the element acting the blade, determining its tilt during the rotation of the respective rotor, being able to be either the roller (23), into contact with the both guiding faces of the respective cam, from which, by means of the mentioned mechanism, the movement is conveyed to the blade shaft, or another element—assuring the permanent contact between the roller (23) or the skid (43) and the guiding face of the respective cam—e.g. the working fluid pressure acting on the active face of the tilting blade, properly shaped, or by means of counterweight properly installed on the lever arm attached to the blade shaft, or by means of springs acting properly either on the blade, if it can freely rotate on its shaft, or on the shaft fitted with the blade, or on other elements of the mechanism, all known in themselves; two cams, one for all the tilting blades on the upper rotor (B) and another for those on the lower rotor (C), made in different constructional variants, either in the shape of circle (24, respectively 25), each having two guiding front faces or only one, fitted inside of a drum (D) or located on the upper lid (4) and on lower lid (5) of the casing (A), or radial cams (34, respectively 35), each having two guiding radial faces or only one, fitted inside of the drum (D), or front cams (41, respectively 42) having one guiding front face, fixed on the outer face of the drum (D), at its extremities the two cams having the same profile permitting, during a complete rotor rotation, that each tilting blade (12) occupy, due to its own driving mechanism, during a rotation fraction—defined by a specific angle $\gamma$—an active position—on the angular sector$\gamma_2$—wherein the upper face (h) of the blade makes an angle $\alpha \leqq 90°$ with the front face of respective rotor, or a passive position—on the angular sector $\gamma_4$—where the upper face (h) of the blade is within the plane of the front surface of the rotor, or a transition phase from passive to active position—on the angular sector $\gamma_1$—or from the active to passive position—on the angular sector $\gamma_3$—the cams being symmetrically arranged against the symmetry plane of the machine so that their guiding surfaces assure the symmetrical arrangement of the angular sector $\gamma_1 \div \gamma_4$ specific to a rotor as compared to those specific to the other rotor against the symmetry plan of the machine; a drum (D) consisting of a central body (45), with a cylindrical outer face, interlocked to a deflector (46) with symmetrical lateral surfaces (u') making a sharp angle between them and connected to the outside face of the body (45), eventually provided with some gaps (v') having curve surfaces, permitting overlapping of the deflector (46) with the angular zone $\gamma_1$, and a rib (47), diametrically opposed, some fitted with stiffening plates (48,49), fixed to the machine stator (A), in the symmetry plan of the machine, by means of spacers (50) and of one elements—screws, nuts—known in themselves, so that, inside the machine are formed two symmetrical, semicircular channels (a), having rectangular passage section, bordered by the front faces of the two rotors (B, C) moving to opposite sense to one another, the inner face of the stator (A) or, possibly, of a cylindrical segment (51) fixed on the inner face of the shell (1) within the zone covered by the angle $\gamma 2$, in view of diminishing the clearance between the channel face and the outer edge of the blade in active position on the rotor, and the outer face of the drum (D), each taking over half of the inlet fluid flow to the machine, the cams (24, 25) profile assuring the tilting of the blades (12) on each of the two rotors in active position in one of the two semicircular channels (a) so that the fluid pressure in each channel, acting on the lower face (i) or (j) of a rotor blade, during the time it is in active position, obstructing the channel section, determines the movement of respective rotor to the flowing sense of the fluid, whereas, due to the fluid flowing to the same sense in the two channels (a), the rotors (B, C) rotate to opposite sense.

2. A hydraulic or pneumatic machine according to claim 1, characterized by the fact that, in view of increasing the passage section and, accordingly, the working fluid flow rate in the machine, it has channels (a) for fluid circulation arranged in a multistaged way, having equal or different dimensions from one stage to the other, in an even number of stages, consisting of a casing (A) inside of which being several rotors grouped by two packages each coupled to one of the motor shafts: a package (H) consisting of two extreme rotors with a front face each, provided with tilting blades, located face to face, one on a machine shaft—either the upper rotor (B) or the lower rotor (C), whereas the other, a ring rotor (E), different from constructional view point only through the lack of the coupling elements on the machine shaft—the disk (8) or (9) and the hub (10), (11) respectively—and, in case the machine has more than two stages, a number of intermediate, ring like rotors ($G_1$, $G_2$ . . . ) located between the extreme rotors, each consisting either of a ring plane (6) fixed on a frame (7) and having two parallel front faces provided with the tilting blades (12), or from an external ring (16) concentric with the inner frame (7) fixed to it by means of some rods (17), possibly radial arranged, which can also serve as position limiters for the tilting blades (12) in passive position, being duly shaped for this function according to the blades profile, all the rotors of the package (H) having the tilting blades identical or different in terms of size and number from one stage to the other and arranged in such a way as to assure them the same moving sense, fixed between them by means of fastening plates (77) and some tie bars (76), spaced on their outer outline, so that, the whole package (H), by the hub (10) or (11) on the rotor fixed on a shaft (B) or (C), conveys the motion to the respective shaft of the machine (52, 67, 53) or (66) depending on the assembling variant chosen; a package (I) consisting of one or several intermediate rotors respectively, in the form of a disk ($F_1$, $F_2$ . . . ) located between the rotors of the other package, similar from constructional view point to the ring like rotors (G), different from these consisting in the existence of the coupling elements, —a disk (9) or (8) provided with a hub (11) or (10)—to the other shaft of the machine (53, 66, 52) or (67), the rotor having two parallel front faces provided with shaped grooves (b) locating tilting blades (12) similar to those existing on the rotors of the other package (H) at the respective stage but arranged in such a manner as to assure it a rotation movement to the opposite sense of the rotors of the other package—the distance between the front faces of the neighboring rotors being constant at all the stages of the machine or different from one stage to the other, depending on blades width—the tilting blades (12) on the two front faces of each intermediate rotor ($F_1$, $F_2$ . . . $G_1$, $G_2$ . . . ) being either each driving or coupled two by two, in view of synchronizing their movement, e.g. by means of some geared segments (81), permanently engaged, installed on the shaft of each blade, so that when one is driven—the leading blade—the other—the led blade—shall any moment take a symmetrical position to it, or in other constructional variant, in view of reducing the thickness of the intermediate rotors (F, G) the latter have the tilting blades (12), placed in opposite positions on the two front faces, being installed coaxially either in a seat, properly shaped, or between the outer ring (16) and the inner frame (7), in some common bearings (13, 14) of the two blades, each blade having on its panel (c) edge one hub consisting of one or several elements (f), alternating with those making the hub of the pair blade, so as to make together a "hinge" type articulation, the two blades being fitted, by their hubs (f), on two coaxial shafts—one filled (15) and one tubular (78)—coupled between them by e.g. by a gear known in themselves, for synchronizing the movement of the two tilting blades (12) when driving one of them—the leading blade—by means of the driving mechanism installed on its shaft, or each being able of a free movement on the common shaft (15), driven either separately, by a spring (44) fitted e.g. in the hub of each blade or simultaneously by a single spring (44) installed between neighboring elements (f) of the tilting blades hubs, acting on the both tilting blades; a number of drums ($D_1$, $D_2$ . . . ) equal to the number of machine stages, each located between the front faces of two neighboring rotors rotating to opposite sense from one another, arranged in the same position with the deflector (46) and rib (47), the extremities of which do not surpass the rotors outline, in the symmetry plane of the inlet and outlet fluid connection respectively, the neighboring drums being fixed to one another so that the rotors movement be not hindered, either through the outside of the disk like intermediate rotors ($F_1$, $F_2$ . . . ) by means of spacers (79) located between the fastening plates (48), (49) respectively coupled to the deflector (46) and to the rib (47) respectively, on each drum, or inside the frame of the ring like intermediate rotors ($G_1$, $G_2$ . . . ) by means of the spacers (79) located between some fastening rings (80) inside each drum, as part of its body (45), the whole drums package thus formed being fastened onto the casing (A) lid located in the vicinity of the extreme ring rotor (E) bymeans of shorter spacers (50) placed between the fastening ring (80) on the closest drum (D), to the lid and the respective lid (4) or (5), located inside the rotor frame (E); driving mechanisms of the tilting blades (12) either for all the rotors of the machine, installed on the shaft of each blade or only on the shaft of the leading blades in the case of intermediate rotors ($F_1$, $F_2$ . . . $G_1$, $G_2$ . . . ) with the blades on the two faces coupled for their movement synchronization, or only for the tilting blades (12) on the rotors located either at the first or the last stage of the rotors package, the movement being simultaneously conveyed from each of them to all the leading blades existing on the same vertical in the respective package of rotors, either, in the case of the rotors package (H, J) by a joint rack (87), located in a casing (88) fitted on the perifery of the rotors making the respective package, engaged with some pinions (86) fixed at the outside of the rotor, on the end of each shaft (15) of the respective leading blades, or, in the case of the rotors package (I, K) by some linking elements coupled to the driving mechanisms of the tilting blades from all the stages of the package, built in different constructional variants, according to the driving mechanism of each tilting blade, known in themselves, e.g. a joint stem (89) hinged to all levers (21) or a joint vertical rack (90) which engages simultaneously the pinions (26) from all the stages, or a joint shaft (91) on which are fixed all the cone gears (30) of the rotors package found on the same vertical, the disks of all rotors making the respective package being provided with orifices (m') permitting the fitting of the mentioned linking elements, the fixed cams (24 and 25, or 34 and 35, or 41 and 42) being arranged in such a way as to assure the simultaneous movement of the blades located on the same vertical generatrix of the respective package of rotors.

3. A hydraulic or pneumatic machine according to claim 2, characterized by the fact that, in a constructional variant, the rotors package fixed between them through the inside (I) consists of a single intermediate disk like rotor ($F_1$) located in the machine in the vicinity of the extreme rotor (B) or (C) of the other package of rotors (H) and a number of intermediate ring like rotors (G), all the rotors of the package being rigidly fixed between them by means of the longitudinal tie bars (76) and the fastening plates (77), equally spaced on the inner outline of each rotor frame (7), inside the drums (D), the whole package of rotors being coupled to the machine shaft by the hub of the disk like rotor ($F_1$), the stator (A) having the lid (4) or (5) located in the vicinity of the extreme ring rotor (E) of the rotors package fixed in between through the outside (H), shaped to the form of the ring rotors (G) and (E) making the two packages.

4. A hydraulic or pneumatic machine according to claim 2, characterized by the fact that, in a constructional variant, in view of making fluid circulation channels (a) multistaged in an uneven number of stages, has the rotors grouped into two packages with an equal number of rotors, each coupled to one of the machine shafts: a package (J) consisting of an extreme rotor, with one front face, fixed on a machine shaft—either the upper rotor (B) or the lower rotor (C)—and a number of intermediate ring rotors ($G_1$, $G_2$ . . . ) with two front faces, all the package rotors being fixed between them by means of longitudinal tie bars (76) and of some fastening plates (77), fitted with tilting blades (12) on their front faces arranged in such a way as to assure them the same rotation sense, the whole package being coupled to the machine shaft (52, 67, 53) or (66) on which the extreme rotor (B) or (C) is fixed by its hub (10) or (11), depending on the assembling variant chosen; a package (K) consisting of the other extreme rotor, with one front face—either the lower (C) or the upper (B) rotor—and a number of intermediate, disk rotors $F_1$, $F_2$ . . . ) with two front faces, interspersed between the rotors of the other package (J), all the package rotors fixed each by its hub (11, 10), on the other machine shaft (53,66, 52) or (67), having on their front faces the tilting blades (12) arranged in such a way as to assure them the same rotation sense, opposite to the other package of rotors (J), between the front faces of two neighboring rotors, rotating to opposite sense from one another, existing one drum each ($D_1$, $D_2$ . . . ) located, with the deflector (46) placed in the symmetry plane of the inlet connection, the neighboring drums being fixed one to the other by means of spacers (79) located between the fastening elements provided on each drum (48,49, 80), the whole package of drums thus formed being fixed on the casing (A) lid located in the vicinity of extreme rotor (C) or (B) as part of the package of disk rotors (K), by shorter spacers (50) located at the outside of the rotor and between the plates (48) and (49) fitted on the closest drum to the lid and the respective lid (4) or (5).

5. A hydraulic or pneumatic machine according to claim 4, characterized by the fact that, in a constructional variant, the package of rotors fixed between them trough the inside (K) consists of a single intermediate disk rotor ($F_1$) located in the vicinity of the extreme rotor (B) or (C) of the other package of rotors (J), a number of intermediate ring rotors (G) and an extreme ring rotor (E), all the package rotors being rigidly fixed between them by means of longitudinal tie—bars (76) and of fastening plates (77), equally spaced on the outline of the inner frame (7) of each rotor, inside the drum (D), the whole package of rotors being coupled to the machine shaft by the hub of the intermediate disk rotor ($F_1$), the stator (A) having the lid (4) or (5) located in the vicinity of the extreme ring rotor (E), shaped to the form of the ring rotors (G) and (E) making the two packages.

6. A hydraulic or pneumatic machine according to claim 1, characterized by the fact that, in view of adjusting it to the use of some pressure fluids, within the annular space covered by the cylindrical shell (1) of the stator (A) and the cylindrical body (45) of the drum (D), interlocked to it, is provided a cylindrical ring (92) whose height corresponds to the distance between the rotors front faces (B, C), having on each front face a groove (a") with variable depth wherein move the tilting blades (12) of the rotor bordering the respective surface—with baffles or sealing labyrinths, known in themselves, concentrically arranged on one or both edges of the channel, eventually at one or both its ends, on a radial direction—the two channels—which, in a constructional variant, linking the inlet and the outlet fluids nozzles, in diametrically opposed positions, and, in other constructional variant, when the height of the cylindrical ring (92) exceeds the sum of the maximum depths of the two channels (a") on its front faces and the channels lengths can be increased so as they partially overlap in plane, being eventually connected to their own fluid inlet (2) and outlet (3) nozzles thus becoming independent to one another, the plane arrangement of the driving mechanism cam of the tilting blade (12) of each rotor (B) or (C) corresponding to the—plane position of respective channel (a")—each having an initial zone (b") with increasing depth to the rotation sense of the respective rotor, on the angular sector $\gamma_1$, characteristic for blade transition from the passive to the active position, possibly a middle zone (c"), with constant depth, maximum equal to the cylindrical ring (92) height, on the angular sector $\gamma_2(\gamma_2 \geqq 0°)$ characteristic for keeping the blade in active position on the rotor, and a terminal zone (d") either having the same depth like the middle zone (c") or with decreasing depth, on the angular sector $\gamma_3$ characteristic for the blade transition from active to passive position, the bottom and the side walls of the channel having, especially in the middle zone(c"), but possibly in the initial zone (b") too, respectively in the terminal zone (d"), the same profile as the surfaces formed by the edges of the tilting blade (12) panel moving in the respective channel, whereas the interstice between the edges of the blade panel and the channel walls, in the respective zone being minimum, so that inside each channel, between the adjacent blades on each rotor, some compartments are formed with a volume varying during the movement of the rotor, to the same sense with the variation of the channel depth; the pressured working fluid—at machine operating as a hydraulic or pneumatic motor—either a gas—coming from e.g. a storage tank or an outside combustion chamber (93) of a combustion mixture, known in themselves or a liquid—entering the machine by a joint feed nozzle (2) or by separate nozzles (2), each connected to radial inlet channels (i") executed in the cylindrical ring (92), gets into the initial zone (b"), simultaneously into both channels and separately respectively, into each one, either by some branches (j"), (u") respectively of the inlet channel (i") connected to a slot (k") made on the shaped face (e") of the channel bottom, and a groove (m") respectively, with a variable or constant depth, made along a certain portion of the same surface, possibly on the entire initial zone (b") of the channel (a") in the case in which the working fluid is a liquid or by some slots (l") executed along a certain length, possibly on the entire initial zone (b") of the channel (a") in the case in which the working fluid is a liquid in one or both lateral faces respectively—outside (g") and inside (h") one—of the channel, directly connected to the respective inlet channel (i"), the pressure value in each compartment covered between two successive blades of the rotor evolving, in function of the working fluid compressibility, either decreasing—at the same time with the increase of its volume—from a maximum value, in the compartments with minimum volume directly connected to the feed nozzle to a minimum value in the compartments with maximum volume located on the middle zone (c"), in the case of a compressible fluid, so that the driving forces determining the rotor movement should be exerted in all the compartments with increasing volume, located in the initial zone (b") of the channel (a") having variable values with time, proportional to the fluid instantaneous pressure and with the height difference between the vertex of the two blades delimitating the compartment, measured in the respective moment against the front face of the rotor, being the same in all the compartments with increasing volume, in case of use of a liquid, the driving forces being exerted on the tilting blades (12) located in the middle zone (c") of the channel (a") due to the fluid pressure difference in the two zones (b", d") bordering it, the torsion moment at the shaft of each rotor resulting from the sum of the moments given by the respective driving forces; the working fluid is discharged from each channel (a") by a common outlet nozzle (3) or separate outlet nozzles (3), either by slots (o") made in one or both the lateral faces—external (g") or internal (h")—along the entire length of the terminal zone (d"), communicating by some radial channels (r") existing in the cylindrical ring (92) with the respective outlet nozzle (3), or by a groove (p") with variable or constant depth made along the bottom surface (f") of the terminal zone (d"), connected by slot (q") to the corresponding radial channels (r"), or, in other constructional variant, having the rotor driven by a momentum applied on its shaft so that the tilting blades (12) should run the channels with variable section (a") to the opposite sense—the angle α vertex between the blade and the front face of the rotor being arranged to the opposite sense of rotation—machine operates like a hydraulic pump or compressor, the working fluid, being sucked in the terminal zone (d") of the channel due to the increase of the volume of the mobile compartments formed on the rotor when running across this zone, through the discharge nozzle (3) becoming the suction nozzle, and discharged through the suction nozzle (2) which became the discharge nozzle, at a pressure higher than the suction pressure.

7. A hydraulic or pneumatic machine according to claim 6, characterized by the fact that, in a constructional variant, the rotors (B) and (C) have one or several concentric rows of tilting blades (12) that may differ from one another, from one rotor to the other or from one row to the other, in terms of shape, dimensions and position on rotor, each row of tilting blades being provided with a driving mechanism of its own, whereas, on the front face of the cylindrical ring (92), bordering the front face of the respective rotor, is a corresponding number of concentric channels ($a_1$", $a_2$" . . . ) with variable depth, framed by baffles or sealing labyrinths eventually, in order to diminish the pressure losses between the neighboring channels or to the outside, the orientation of the driving mechanisms of the tilting blades on each row of the rotor blades being correlated to the plane position of the channel ($a_1$", $a_2$" . . . ) they run in, each the channels ($a_1$", $a_2$" . . . ) could be either independent, each having an inlet (2) and outlet (3) connection of its own, so that on the surface of each rotor are formed independent circuits with the same or different fluids, the number of which is equal to the number of the concentric rows of tilting blades, the orientation of the angle vertex a formed between the blades of each row and the rotor surface—to the rotor moving sense or its opposite sense—determining the operating conditions of each circuit—motor, pump or compressor respectively, whereas the two outlet shafts of the machine, coupled to the rotors (B, C) can rotate to the same or opposite senses, or coupled between them those from the same or opposite surfaces of the cylindrical ring (92)—either in series, one in continuation to the other, by a shaped intermediate channel ($t_{i,i+1}$") connecting the terminal zone ($d_i$") of a channel to the initial zone ($b_{i+1}$") of the other channel, forming an independent circuit where the working fluid incoming and outgoing is carried out at the circuits ends whereas, by adequately choosing the section of each channel and the dimensions and number of the tilting blades (12) running in it, it is assured the steady increase and decrease respectively of the volume of each compartment covered between two successive tilting blades along the whole circuit, so that, depending on the moving sense of the blades in the channels, the fluid is subject from the circuit inlet to outlet to a prolonged expansions—compression respectively, or in parallel, with joint inlet and outlet connections, run to the same sense by the rotor tilting blades, on the cylindrical ring (92) faces eventually existing simultaneously independent circuits formed of one channel and circuits formed of several channels, coupled in series or in parallel, each circuit running according to the tilting blades orientation against the rotor as a motor or as a pump, with the same or different fluids, so, in a constructional variant, by the adequate orientation of the channels ($a_1$", $a_2$" . . . ) and tilting blades (12) corresponding to these, the two rotors (B,C) have the same moving sense and they can be mounted on the same outlet shaft of the machine.

8. A hydraulic or pneumatic machine according to claim 7, characterized by the fact that, in a constructional variant, is multistaged, the rotors of each stage, with the same or different diameters—having the tilting blades arranged on one or several concentric rows, either with an even number of stages, having several rotors grouped by two packages each coupled to one of the motor shafts: a package (H) consisting of two extreme rotors with a front face each, provided with tilting blades, located face to face, one on a machine shaft—either the upper rotor (B) or the lower rotor (C), whereas the other, a ring rotor (E), different from constructional view point only through the lack of the coupling elements on the machine shaft—the disk (8) or (9) and the hub (10), (11) respectively—and, in case the machine has more than two stages, a number of intermediate, ring like rotors ($G_1$, $G_2$ . . . ) located between the extreme rotors, each consisting of a ring plane (6) fixed on a frame (7) and having two parallel front faces provided with tilting blades (12), all the rotors of the package (H), fixed between them by elements known in themselves, for example by means of fastening plates (77) and some tie bars (76), located on their outer outline, so that, the whole package (H), by the hub (10) or (11) on the rotor fixed on a shaft (B) or (C), conveys the motion to the respective shaft of the machine (52, 67, 53 or 66), and a package (I) consisting of one or several intermediate rotors respectively, in the form of a disk ($F_1$, $F_2$ . . . ) intercalated between the rotors of the other package, similar from constructional view point to the ring like rotors (G), different from these consisting in the existence of the coupling elements—a disk (9 or 8) provided with a hub (11 or 10)—to the other shaft of the machine (53, 66, 52 or 67), the rotor having two parallel front faces provided with tilting blades (12) similar to those existing on the rotors of the other package (H) at the respective stage but arranged in such a manner as to assure it a rotation movement to the opposite sense of the rotors of the other package or with odd number of stages—having the rotors grouped into two packages with an equal number of rotors, each coupled to one of the machine shafts: a package (J) consisting of an extreme rotor, with one front face, fixed on a machine shaft—either the upper rotor (B) or the lower rotor (C)—and a number of intermediate ring rotors ($G_1$, $G_2$ . . . ) with two front faces, all the package rotors being fixed between them, fitted with tilting blades (12) on their front faces arranged in such a way as to assure them the same rotation sense, the whole package being coupled to the machine shaft (52, 67, 53 or 66) on which the extreme rotor (B) or (C) is fixed by its hub (10) or (11), and a package (K) consisting of the other extreme rotor, with one front face—either the lower (C) or the upper (B) rotor—and a number of intermediate disk rotors ($F_1$, $F_2$ . . . ) with two front faces, interspersed between the rotors of the other package (J)—all the package rotors fixed each by its hub (11, 10), on the other machine shaft (53, 66,52 or 67), having on their front faces the tilting blades (12) arranged in such a way as to assure them the same rotation sense, opposite to the other package of rotors (J), the distance between the front faces of the neigbboring rotors being constant at all the stages of the machine or different from one stage to the other, depending on the height of the cylindrical ring (92) fitted with the drum (D)—the tilting blades (12) on the two front faces of each intermediate rotor ($F_1$, $F_2$ . . . $G_1$, $G_2$ . . . ) being either independent acted, or coupled two by two, in view of synchronizing their movement, e.g. by means of some geared segments (81), permanently engaged, installed on the shaft of each blade, or in other manner, known in themselves, so that when one is driven—the leading blade—the other—the led blade—shall any moment take a symmetrical position to it; a number of drums ($D_1$, $D_2$ . . . ) equal to the number of machine stages, each drum (D) being fitted with a cylindrical ring (92) whose height corresponds to the distance between the front faces of the neighboring rotors, having on each front face of its one or more channels (a") with variable depth, wherein move the tilting blades (12) of the rotor neighboring to the respective face, the channels (a") provided at various stages of the machine being capable to be coupled between them by means of pipes (95) connecting the radial inlet (i")—outlet (r") channels respectively—from one stage to those of the other stage, according to the connections plan chosen for the formation of a circuit, directly, if the two stages are consecutive, or by crossing the cylindrical rings (92) of the intercalated stages, provided for this purpose with some properly arranged radial channels (w"), communicating to the respective connecting pipes (95), the latter being located either to the outside of the cylindrical rings (92), or inside the drums (D), in the same way as the fastening elements of the neighboring drums (D), the position of the inlet (i")—outlet (r") radial channels—to the outside or the inside of the cylindrical ring (92)—being determined by the position of the respective connecting pipe, whereas the inlet (2) and outlet (3) nozzles of the machine, for each circuit, are located on the cylindrical ring (92) making part of the drum (D) directly mounted on the machine casing, the neighboring drums with cylindrical rings (92) being fastened to one another so that the rotors movement be not hindered, either by means of spacing rings (94) placed between the two adjacent, cylindrical rings (92), concentrically to them—either outside the disk rotors (F) or inside the ring rotors (G)—which can be provided with some channels (u") and (v"), linked to the inlet (i")—outlet (r") channels respectively, made in the neighboring cylindrical rings (92) in order to couple the fluid circuits of the various stages of the machine, or by other means, known in themselves, the whole drums package thus formed being fastened onto the casing (A) lid located in the vicinity of the extreme ring rotor (E); driving mechanisms of the tilting blades (12), either for all the rotors of the machine, installed on the shaft of each blade, dismissing the permanent coupling of the tilting blades located on the opposite faces of the intermediate rotors (F, G), so that the cams of the independent driving mechanisms of the blades at each stage can have a different plane arrangement from one stage to the other, according to the arrangement of the grooves with variable sections (a") the tilting blades (12) run in, on the respective stage and row, or only on the shaft of the leading blades in the case of intermediate rotors ($F_1$, $F_2$ . . . $G_1$, $G_2$ . . . ) with the blades on the two faces coupled between them in order to assure the synchronized movement of them, or only for the tilting blades (12) on the rotors located either at the first or the last stage of the rotors package, the movement being simultaneously conveyed from each of them to all the leading blades existing on the same vertical in the respective package of rotors, either, in the case of the rotors package (H, J) by a joint rack (87), located in a casing (88) fitted on the perifery of the rotors making the respective package, engaged with some pinions (86) fixed at the outside of the rotor, on the end of each shaft (15) of the respective leading blades, or, in the case of the rotors package (I, K) by some linking elements coupled to the driving mechanisms of the tilting blades from all the stages of the package, built in different constructional variants, according to the driving mechanism of each tilting blade, known in themselves, e.g. a joint stem (89) hinged to all levers (21) or a joint vertical rack (90) which engages simultaneously the pinions (26) from all the stages, or a joint shaft (91) on which are fixed all the cone gears (30) of the rotors package found on the same vertical, the disks of all rotors making the respective package being provided with orifices (m') permitting the fitting of the mentioned linking elements.

9. A hydraulic or pneumatic machine according to claim 8, characterized by the fact that, in a constructional variant, in view of diminishing the resulting axial forces acting on the two shafts, the rotors packages consist only of rotors with tilting blades (12) on both faces—either a disk rotor (F) coupled to each of the machine shafts or a package (I) of disk rotors (F), each coupled directly to one of the machine shaft, and a package (J) consisting of ring rotors (G) and an extreme rotor (B) or (C) devoid of tilting blades on its front face, meant only to couple the whole package (J) to the other machine shaft by its disk (8,9) respectively, extended up to the machine periphery, and its hub (10,11) respectively, as part of it, whereas the cylindrical rings (92) fitted on the drums (D) of each stage, have corresponding channels (a"), with variable depth, on one or both front faces as they border one front face with tilting blades (12), in the case of the rings located at extremities, or two front faces with tilting blades (12) in the case of those located in intermediate positions, in the particular case when the tilting blades on the two front faces of each rotor are identical as form and arrangement and the fluids pressure in the corresponding channels (a") with variable depth are equal, the axial force is zero.

10. A hydraulic or pneumatic machine according to claim 7, characterized by the fact that, in a constructional variant, has a single extreme rotor (B) or (C) provided with one or several rows of tilting blades (12), the cylindrical ring (92) having, accordingly, one or several channels with variable depth (a") on the neighboring face of the rotor and being fastened on the lid (5), (4) respectively opposite to the respective rotor.

11. A hydraulic or pneumatic machine according to claim 8, characterized by the fact that, in a constructional variant, in view of diminishing the resulting axial force acting on the rotor, has either a single disk type rotor (F) with tilting blades (12) on both faces, or several disk type rotors (F) spaced between them, in the form of package (I) of rotors mounted on a single machine shaft (52) or (53), eventually capable of free axial movement on it, two cylindrical rings (92) with variable depth channels (a") on one face, mounted on the upper (4) and lower (5) lids of the casing (A) and a number of cylindrical rings (92) respectively, with variable depth channels (a") on both faces, located between the front faces of the neighboring rotors.

12. A hydraulic or pneumatic machine according to claim 8, characterized by the fact that, in a constructional variant, in view of diminishing the resulting axial forces acting on the shaft, has either a single ring type (G) rotor with tilting blades on both faces, or several ring type (G) rotors spaced between them, and an extreme rotor (B) or (C) devoid of tilting blades on its front face, all making a package of rotors fixed on one motor outlet shaft (52) or (53) by the disk (8) or (9) extended up to the extreme rotor periphery (B) or (C) and by the its hub (10) or (11), or it can freely move axially on the respective shaft, two cylindrical rings (92) with variable depth channels (a") on one face and, eventually, a number of cylindrical rings (92) with variable depth channels (a") on both faces, located between the neighboring front faces provided with tilting blades.

13. A pneumatic machine according to claim 7, characterized by the fact that, in a constructional variant the working fluid consists of the gases resulting from fuel combustion in a combustion chamber equipped with devices for the supply, formation and ignition, of fuel mixture, all known in themselves, located either outside (93) or inside (s") the machine, id est in a cylindrical ring (92) connected, by means of the inlet connection (2) by one or several radial channels (i") respectively, to the channels with variable depth (a") of a motor circuit wherein the tilting blades of the rotors run, the compression of the air or of the fuel mixture fed into the combustion chamber being achieved either in a separate compressor or in a pumping circuit consisting of one or several channels with variable depth (a") inside the same machine.

14. A pneumatic machine according to claim 8, characterized by the fact that, in a constructional variant the working fluid consists of the gases resulting from fuel combustion in a combustion chamber equipped with devices for the supply, formation and ignition, of fuel mixture, all known in themselves, located either outside (93) or inside (s") the machine, id est in a cylindrical ring (92) or in a ring spacer (94) connected, by means of the inlet connection (2) by one or several radial channels (i") respectively, to the channels with variable depth (a") of a motor circuit wherein the tilting blades of the rotors run, the compression of the air or of the fuel mixture fed into the combustion chamber being achieved either in a separate compressor or in a pumping circuit consisting of one or several channels with variable depth (a") inside the same machine.

15. A pneumatic machine according to claim 9, characterized by the fact that, in a constructional variant the working fluid consists of the gases resulting from fuel combustion in a combustion chamber equipped with devices for the supply, formation and ignition, of fuel mixture, all known in themselves, located either outside (93) or inside (s") the machine, id est in a cylindrical ring (92) or in a ring spacer (94) connected, by means of the inlet connection (2) by one or several radial channels (i") respectively, to the channels with variable depth (a") of a motor circuit wherein the tilting blades of the rotors run, the compression of the air or of the fuel mixture fed into the combustion chamber being achieved either in a separate compressor or in a pumping circuit consisting of one or several channels with variable depth (a") inside the same machine.

16. A pneumatic machine according to claim 10, characterized by the fact that, in a constructional variant the working fluid consists of the gases resulting from fuel combustion in a combustion chamber equipped with devices for the supply, formation and ignition, of fuel mixture, all known in themselves, located either outside (93) or inside (s") the machine, id est in a cylindrical ring (92) or in a ring spacer (94) connected, by means of the inlet connection (2) by one or several radial channels (i") respectively, to the channels with variable depth (a") of a motor circuit wherein the tilting blades of the rotors run, the compression of the air or of the fuel mixture fed into the combustion chamber being achieved either in a separate compressor or in a pumping circuit consisting of one or several channels with variable depth (a") inside the same machine.

17. A pneumatic machine according to claim 11, characterized by the fact that, in a constructional variant the working fluid consists of the gases resulting from fuel combustion in a combustion chamber equipped with devices for the supply, formation and ignition, of fuel mixture, all known in themselves, located either outside (93) or inside (s") the machine, id est in a cylindrical ring (92) or in a ring spacer (94) connected, by means of the inlet connection (2) by one or several radial channels (i") respectively, to the channels with variable depth (a") of a motor circuit wherein the tilting blades of the rotors run, the compression of the air or of the fuel mixture fed into the combustion chamber being achieved either in a separate compressor or in a pumping circuit consisting of one or several channels with variable depth (a") inside the same machine.

18. A pneumatic machine according to claim 12, characterized by the fact that, in a constructional variant the working fluid consists of the gases resulting from fuel combustion in a combustion chamber equipped with devices for the supply, formation and ignition, of fuel mixture, all known in themselves, located either outside (93) or inside (s") the machine, id est in a cylindrical ring (92) or in a ring spacer (94) connected, by means of the inlet connection (2) by one or several radial channels (i") respectively, to the channels with variable depth (a") of a motor circuit wherein the tilting blades of the rotors run, the compression of the air or of the fuel mixture fed into the combustion chamber being achieved either in a separate compressor or in a pumping circuit consisting of one or several channels with variable depth (a") inside the same machine.

* * * * *